US012478112B2

(12) United States Patent
Gage et al.

(10) Patent No.: US 12,478,112 B2
(45) Date of Patent: Nov. 25, 2025

(54) SMOKING ARTICLE CARTRIDGE

(71) Applicant: R.J. Reynolds Tobacco Company, Winston-Salem, NC (US)

(72) Inventors: Justin William Gage, Greensboro, NC (US); Billy Tyrone Conner, Clemmons, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 557 days.

(21) Appl. No.: 16/174,846

(22) Filed: Oct. 30, 2018

(65) Prior Publication Data

US 2020/0128880 A1 Apr. 30, 2020

(51) Int. Cl.

| | |
|---|---|
| ***A24F 42/60*** | (2020.01) |
| ***A24B 15/167*** | (2020.01) |
| ***A24D 1/14*** | (2006.01) |
| ***A24F 42/10*** | (2020.01) |
| *A24B 15/16* | (2020.01) |
| *A24D 1/22* | (2020.01) |

(52) U.S. Cl.

CPC ..... *A24F 42/60* (2020.01); *A24B 15/167* (2016.11); *A24D 1/14* (2013.01); *A24F 42/10* (2020.01); *A24B 15/165* (2013.01); *A24D 1/22* (2020.01)

(58) Field of Classification Search

CPC ..... A24D 1/22; A24F 42/60
USPC ..... 131/330
See application file for complete search history.

(56) References Cited

U.S. PATENT DOCUMENTS

| | | | |
|---|---|---|---|
| 1,514,682 | A | 11/1924 | Wilson |
| 1,771,366 | A | 7/1930 | Wyss et al. |
| 2,057,353 | A | 10/1936 | Whittemore, Jr. |
| 2,104,266 | A | 1/1938 | McCormick |
| 3,200,819 | A | 8/1965 | Gilbert |
| 3,479,561 | A | 11/1969 | Janning |
| 4,219,031 | A | 8/1980 | Rainer et al. |
| 4,284,089 | A | 8/1981 | Ray |
| 4,303,083 | A | 12/1981 | Burruss, Jr. |
| 4,714,082 | A | 12/1987 | Banerjee et al. |
| 4,735,217 | A | 4/1988 | Gerth et al. |

(Continued)

FOREIGN PATENT DOCUMENTS

| | | |
|---|---|---|
| AU | 276250 | 7/1965 |
| CA | 2 641 869 | 5/2010 |

(Continued)

OTHER PUBLICATIONS

Chemical and Biological Studies on New Cigarette Prototypes that Heat Instead of Burn Tobacco, RJRTC Monograph, 1988, pp. 44-45, 53-55, 57, 63.

*Primary Examiner* — Russell E Sparks
(74) *Attorney, Agent, or Firm* — Womble Bond Dickinson (US) LLP

(57) ABSTRACT

A smoking article includes a mouth end portion in fluid communication with an aerosol generating cartridge. The cartridge includes an enclosure configured to receive an aerosol precursor therein, with the aerosol precursor being configured to generate an aerosol in response to heat. At least a portion of the enclosure is permeable such that the aerosol precursor is retained within the enclosure while the aerosol formed from the aerosol precursor is released from the enclosure through the permeable portion upon heating of the enclosure or the aerosol precursor therein.

31 Claims, 5 Drawing Sheets

(56) References Cited

Figure 1:
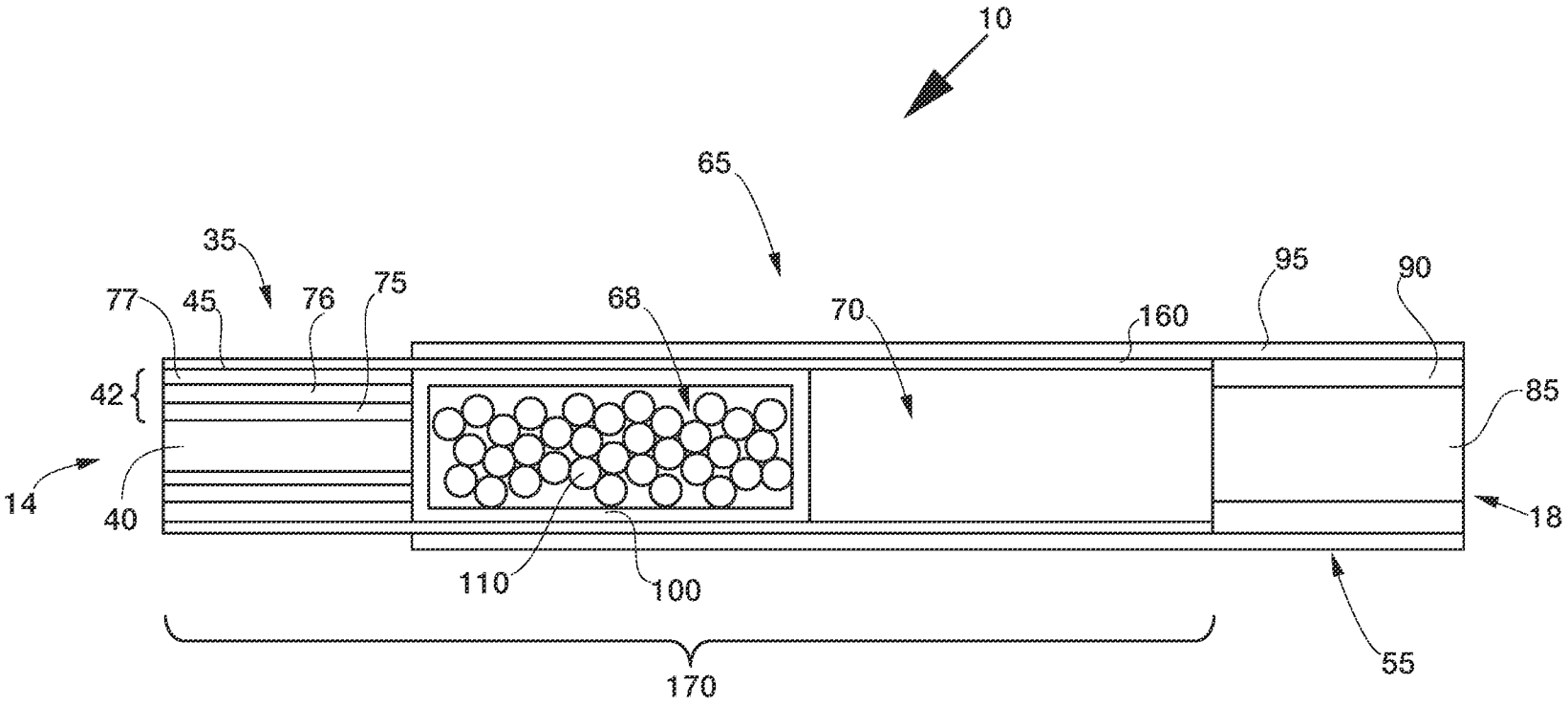

U.S. PATENT DOCUMENTS 4,756,318 A 7/1988 Clearman et al.
4,765,347 A * 8/1988 Sensabaugh, Jr. ..... A24F 42/60 131/273
4,793,365 A 12/1988 Sensabaugh, Jr. et al.
4,807,809 A 2/1989 Pryor et al.
4,819,665 A 4/1989 Roberts et al.
4,848,374 A 7/1989 Chard et al.
4,858,630 A 8/1989 Banerjee
4,881,556 A 11/1989 Clearman et al.
4,893,637 A 1/1990 Hancock et al.
4,893,639 A 1/1990 White
4,907,606 A 3/1990 Lilja et al.
4,920,990 A 5/1990 Lawrence et al.
4,922,901 A 5/1990 Brooks et al.
4,938,238 A 7/1990 Barnes et al.
4,945,931 A 8/1990 Gori
4,947,874 A 8/1990 Brooks et al.
4,947,875 A 8/1990 Brooks et al.
4,986,286 A 1/1991 Roberts et al.
4,987,908 A 1/1991 Sprinkel
4,989,619 A 2/1991 Clearman et al.
5,007,440 A 4/1991 Robinson et al.
5,019,122 A 5/1991 Clearman et al.
5,020,548 A 6/1991 Farrier et al.
5,025,814 A 6/1991 Raker
5,027,836 A 7/1991 Shannon et al.
5,027,837 A 7/1991 Clearman et al.
5,042,510 A 8/1991 Curtiss et al.
5,060,671 A 10/1991 Counts et al.
5,060,673 A 10/1991 Lehman
5,065,776 A 11/1991 Lawson et al.
5,066,691 A 11/1991 Kumakura
5,067,499 A 11/1991 Banerjee et al.
5,076,297 A 12/1991 Farrier et al.
5,093,894 A 3/1992 Deevi et al.
5,099,861 A 3/1992 Clearman
5,101,839 A 4/1992 Jakob et al.
5,105,831 A 4/1992 Banerjee et al.
5,105,836 A 4/1992 Gentry et al.
5,105,838 A 4/1992 White et al.
5,109,122 A 4/1992 Takeuchi et al.
5,129,409 A 7/1992 White et al.
5,144,962 A 9/1992 Counts et al.
5,148,821 A 9/1992 Best et al.
5,156,170 A 10/1992 Clearman et al.
5,159,942 A 11/1992 Brinkley et al.
5,178,167 A 1/1993 Riggs et al.
5,183,062 A 2/1993 Clearman et al.
5,203,355 A 4/1993 Clearman et al.
5,211,684 A 5/1993 Shannon et al.
5,247,947 A 9/1993 Clearman et al.
5,249,586 A 10/1993 Morgan et al.
5,261,424 A 11/1993 Sprinkel, Jr.
5,271,419 A 12/1993 Arzonico et al.
5,303,720 A 4/1994 Banerjee et al.
5,322,075 A 6/1994 Deevi et al.
5,327,917 A 7/1994 Lekwauwa et al.
5,345,955 A 9/1994 Clearman et al.
5,353,813 A 10/1994 Deevi et al.
5,369,723 A 11/1994 Counts et al.
5,372,148 A 12/1994 McCafferty et al.
5,388,574 A 2/1995 Ingebrethsen et al.
5,396,911 A 3/1995 Casey, III et al.
5,408,574 A 4/1995 Deevi et al.
5,461,879 A 10/1995 Bolton et al.
5,468,936 A 11/1995 Deevi et al.
5,469,871 A 11/1995 Barnes et al.
5,498,850 A 3/1996 Das
5,515,842 A 5/1996 Ramseyer et al.
5,530,225 A 6/1996 Hajaligol
5,533,530 A 7/1996 Young et al.
5,546,965 A 8/1996 White
5,551,451 A 9/1996 Riggs et al.
5,560,376 A 10/1996 Meiring et al.
5,564,442 A 10/1996 MacDonald et al.
5,588,446 A 12/1996 Clearman
5,598,868 A 2/1997 Jakob et al.
5,611,360 A 3/1997 Tang
5,649,554 A 7/1997 Sprinkel et al.
5,666,977 A 9/1997 Higgins et al.
5,687,746 A 11/1997 Rose et al.
5,706,834 A 1/1998 Meiring et al.
5,715,844 A 2/1998 Young et al.
5,724,997 A 3/1998 Smith et al.
5,726,421 A 3/1998 Fleischhauer et al.
5,727,571 A 3/1998 Meiring et al.
5,743,251 A 4/1998 Howell et al.
5,799,663 A 9/1998 Gross et al.
5,819,756 A 10/1998 Mielordt
5,865,185 A 2/1999 Collins et al.
5,865,186 A 2/1999 Volsey, II
5,878,752 A 3/1999 Adams et al.
5,894,841 A 4/1999 Voges
5,902,431 A 5/1999 Wilkinson et al.
5,934,289 A 8/1999 Watkins et al.
5,944,025 A 8/1999 Cook et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,125,853 A 10/2000 Susa et al.
6,155,268 A 12/2000 Takeuchi
6,164,287 A 12/2000 White
6,196,218 B1 3/2001 Voges
6,196,219 B1 3/2001 Hess et al.
6,378,528 B1 4/2002 Beeson et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,772,756 B2 8/2004 Shayan
6,803,545 B2 10/2004 Blake et al.
6,849,085 B2 2/2005 Marton
6,854,461 B2 2/2005 Nichols
6,854,470 B1 2/2005 Pu
7,117,867 B2 10/2006 Cox et al.
7,293,565 B2 11/2007 Griffin et al.
7,479,098 B2 1/2009 Thomas et al.
7,513,253 B2 4/2009 Kobayashi et al.
7,647,932 B2 1/2010 Cantrell et al.
7,753,056 B2 7/2010 Borschke et al.
7,775,459 B2 8/2010 Martens, III et al.
7,789,089 B2 9/2010 Dube et al.
7,793,665 B2 9/2010 Dube et al.
7,832,410 B2 11/2010 Hon
7,836,897 B2 11/2010 Borschke et al.
7,845,359 B2 12/2010 Montaser
7,896,006 B2 3/2011 Hamano et al.
8,119,555 B2 2/2012 Banerjee et al.
8,127,772 B2 3/2012 Montaser
8,186,359 B2 5/2012 Ademe et al.
8,314,591 B2 11/2012 Terry et al.
8,365,742 B2 2/2013 Hon
8,393,335 B1 3/2013 Sinclair, Jr.
8,402,976 B2 3/2013 Fernando et al.
8,424,538 B2 4/2013 Thomas et al.
8,464,726 B2 6/2013 Sebastian et al.
8,469,035 B2 6/2013 Banerjee et al.
8,499,766 B1 8/2013 Newton
8,528,569 B1 9/2013 Newton
8,550,069 B2 10/2013 Alelov
8,616,217 B2 12/2013 Tsurizumi et al.
8,617,263 B2 12/2013 Banerjee et al.
8,678,013 B2 3/2014 Crooks et al.
8,839,799 B2 9/2014 Conner et al.
8,851,081 B2 10/2014 Fernando et al.
8,915,254 B2 * 12/2014 Monsees ..... A24F 40/42 131/273
8,915,255 B2 12/2014 Poget et al.
8,991,402 B2 * 3/2015 Bowen ..... B32B 15/09 131/194
9,459,021 B2 10/2016 Greim et al.

(56) References Cited

U.S. PATENT DOCUMENTS

| | | | | |
|---|---|---|---|---|
| 9,516,899 | B2 | 12/2016 | Plojoux et al. | |
| 9,682,204 | B2 * | 6/2017 | Matsumoto | A24F 42/20 |
| 9,877,511 | B2 * | 1/2018 | Li | A24D 3/17 |
| 10,064,430 | B2 * | 9/2018 | Ugurhan | A24B 13/00 |
| 10,881,143 | B2 * | 1/2021 | Suzuki | A61M 11/042 |
| 2002/0146242 | A1 | 10/2002 | Vieira | |
| 2003/0226837 | A1 | 12/2003 | Blake et al. | |
| 2004/0118401 | A1 | 6/2004 | Smith et al. | |
| 2004/0129280 | A1 | 7/2004 | Woodson et al. | |
| 2004/0200488 | A1 | 10/2004 | Felter et al. | |
| 2004/0226568 | A1 | 11/2004 | Takeuchi et al. | |
| 2005/0016550 | A1 | 1/2005 | Katase | |
| 2005/0066896 | A1 | 3/2005 | Nestor et al. | |
| 2005/0274390 | A1 | 12/2005 | Banerjee et al. | |
| 2006/0016453 | A1 | 1/2006 | Kim | |
| 2006/0196518 | A1 | 9/2006 | Hon | |
| 2007/0074734 | A1 | 4/2007 | Braunshteyn et al. | |
| 2007/0102013 | A1 | 5/2007 | Adams et al. | |
| 2007/0215167 | A1 | 9/2007 | Crooks et al. | |
| 2007/0215168 | A1 | 9/2007 | Banerjee et al. | |
| 2008/0085103 | A1 | 4/2008 | Beland et al. | |
| 2008/0092912 | A1 | 4/2008 | Robinson et al. | |
| 2008/0257367 | A1 | 10/2008 | Paterno et al. | |
| 2008/0276947 | A1 | 11/2008 | Martzel | |
| 2008/0302374 | A1 | 12/2008 | Wengert et al. | |
| 2009/0044818 | A1 | 2/2009 | Takeuchi et al. | |
| 2009/0095311 | A1 | 4/2009 | Hon | |
| 2009/0095312 | A1 | 4/2009 | Herbrich et al. | |
| 2009/0126745 | A1 | 5/2009 | Hon | |
| 2009/0188490 | A1 | 7/2009 | Hon | |
| 2009/0230117 | A1 | 9/2009 | Fernando et al. | |
| 2009/0272379 | A1 | 11/2009 | Thorens et al. | |
| 2009/0283103 | A1 | 11/2009 | Nielsen et al. | |
| 2009/0320863 | A1 | 12/2009 | Fernando et al. | |
| 2010/0043809 | A1 | 2/2010 | Magnon | |
| 2010/0083959 | A1 | 4/2010 | Siller | |
| 2010/0108081 | A1 | 5/2010 | Blevins Joyce et al. | |
| 2010/0108084 | A1 | 5/2010 | Norman et al. | |
| 2010/0200006 | A1 | 8/2010 | Robinson et al. | |
| 2010/0229881 | A1 | 9/2010 | Hearn | |
| 2010/0242974 | A1 | 9/2010 | Pan | |
| 2010/0307518 | A1 | 12/2010 | Wang | |
| 2010/0313901 | A1 | 12/2010 | Fernando et al. | |
| 2011/0005535 | A1 | 1/2011 | Xiu | |
| 2011/0011396 | A1 | 1/2011 | Fang | |
| 2011/0036363 | A1 | 2/2011 | Urtsev et al. | |
| 2011/0036365 | A1 | 2/2011 | Chong et al. | |
| 2011/0036367 | A1 | 2/2011 | Saito et al. | |
| 2011/0094523 | A1 | 4/2011 | Thorens et al. | |
| 2011/0126848 | A1 | 6/2011 | Zuber et al. | |
| 2011/0155153 | A1 | 6/2011 | Thorens et al. | |
| 2011/0155718 | A1 | 6/2011 | Greim et al. | |
| 2011/0168194 | A1 | 7/2011 | Hon | |
| 2011/0265806 | A1 | 11/2011 | Alarcon et al. | |
| 2011/0271971 | A1 | 11/2011 | Tyrone et al. | |
| 2011/0309157 | A1 | 12/2011 | Yang et al. | |
| 2012/0042885 | A1 | 2/2012 | Stone et al. | |
| 2012/0060853 | A1 | 3/2012 | Robinson et al. | |
| 2012/0067360 | A1 | 3/2012 | Conner et al. | |
| 2012/0111347 | A1 | 5/2012 | Hon | |
| 2012/0132643 | A1 | 5/2012 | Choi et al. | |
| 2012/0227752 | A1 | 9/2012 | Alelov | |
| 2012/0231464 | A1 | 9/2012 | Yu et al. | |
| 2012/0260927 | A1 | 10/2012 | Liu | |
| 2012/0279512 | A1 | 11/2012 | Hon | |
| 2012/0318882 | A1 | 12/2012 | Abehasera | |
| 2013/0037041 | A1 | 2/2013 | Worm et al. | |
| 2013/0056013 | A1 | 3/2013 | Terry et al. | |
| 2013/0081625 | A1 | 4/2013 | Rustad et al. | |
| 2013/0081642 | A1 | 4/2013 | Safari | |
| 2013/0118513 | A1 | 5/2013 | Kaljura | |
| 2013/0133675 | A1 | 5/2013 | Shinozaki et al. | |
| 2013/0167849 | A1 | 7/2013 | Ademe et al. | |
| 2013/0192619 | A1 | 8/2013 | Tucker et al. | |
| 2013/0255702 | A1 | 10/2013 | Griffith, Jr. et al. | |
| 2013/0269720 | A1 | 10/2013 | Stone et al. | |
| 2013/0306084 | A1 | 11/2013 | Flick | |
| 2013/0319439 | A1 | 12/2013 | Gorelick et al. | |
| 2013/0340750 | A1 | 12/2013 | Thorens et al. | |
| 2013/0340775 | A1 | 12/2013 | Juster et al. | |
| 2014/0000638 | A1 | 1/2014 | Sebastian et al. | |
| 2014/0060554 | A1 | 3/2014 | Collett et al. | |
| 2014/0060555 | A1 | 3/2014 | Chang et al. | |
| 2014/0096781 | A1 | 4/2014 | Sears et al. | |
| 2014/0096782 | A1 | 4/2014 | Ampolini et al. | |
| 2014/0109921 | A1 | 4/2014 | Chen | |
| 2014/0157583 | A1 | 6/2014 | Ward et al. | |
| 2014/0209105 | A1 | 7/2014 | Sears et al. | |
| 2014/0253144 | A1 | 9/2014 | Novak et al. | |
| 2014/0261408 | A1 | 9/2014 | DePiano et al. | |
| 2014/0261470 | A1 | 9/2014 | Amiss et al. | |
| 2014/0261486 | A1 | 9/2014 | Potter et al. | |
| 2014/0261487 | A1 | 9/2014 | Chapman et al. | |
| 2014/0261495 | A1 | 9/2014 | Novak et al. | |
| 2014/0270727 | A1 | 9/2014 | Ampolini et al. | |
| 2014/0270729 | A1 | 9/2014 | DePiano et al. | |
| 2014/0270730 | A1 | 9/2014 | DePiano et al. | |
| 2014/0345631 | A1 | 11/2014 | Bowen et al. | |
| 2015/0007838 | A1 | 1/2015 | Fernando et al. | |
| 2015/0053217 | A1 | 2/2015 | Steingraber et al. | |
| 2015/0083150 | A1 | 3/2015 | Conner et al. | |
| 2015/0157052 | A1 | 6/2015 | Ademe et al. | |
| 2015/0296882 | A1 | 10/2015 | Mironov | |
| 2015/0351456 | A1 * | 12/2015 | Johnson | A24F 40/30 131/329 |
| 2016/0037826 | A1 | 2/2016 | Hearn et al. | |
| 2016/0073695 | A1 * | 3/2016 | Sears | A24F 40/30 131/329 |
| 2017/0000188 | A1 | 1/2017 | Nordskog et al. | |
| 2017/0055576 | A1 * | 3/2017 | Beeson | A24D 1/22 |
| 2017/0164654 | A1 * | 6/2017 | Ademe | A24F 47/006 |
| 2018/0116280 | A1 | 5/2018 | Maiwald et al. | |
| 2018/0280637 | A1 * | 10/2018 | Mayle | A24F 40/60 |
| 2018/0343917 | A1 * | 12/2018 | Sutton | A24B 15/167 |
| 2019/0098930 | A1 * | 4/2019 | Fallon | A24F 40/42 |
| 2019/0269174 | A1 * | 9/2019 | Robert | A24F 42/10 |
| 2020/0037667 | A1 * | 2/2020 | Woodcock | A24F 40/30 |
| 2020/0253286 | A1 * | 8/2020 | Woodman | A24C 5/1828 |
| 2020/0260777 | A1 * | 8/2020 | Rojo-Calderon | A24F 42/80 |
| 2020/0390147 | A1 | 12/2020 | Eusepi et al. | |
| 2021/0298346 | A1 * | 9/2021 | Ghanouni | A24B 15/30 |

FOREIGN PATENT DOCUMENTS

| | | | |
|---|---|---|---|
| CN | 1541577 | | 11/2004 |
| CN | 2719043 | | 8/2005 |
| CN | 200997909 | | 1/2008 |
| CN | 101116542 | | 2/2008 |
| CN | 101176805 | | 5/2008 |
| CN | 201379072 | | 1/2010 |
| CN | 206079044 | U | 4/2017 |
| CN | 107708452 | A | 2/2018 |
| DE | 10 2006 004 484 | | 8/2007 |
| DE | 102006041042 | | 3/2008 |
| DE | 20 2009 010 400 | | 11/2009 |
| EP | 0 295 122 | | 12/1988 |
| EP | 0 430 566 | | 6/1991 |
| EP | 0 845 220 | | 6/1998 |
| EP | 1 618 803 | | 1/2006 |
| EP | 1 808 087 | A1 | 7/2007 |
| EP | 2 316 286 | | 5/2011 |
| EP | 2 550 879 | A1 | 1/2013 |
| EP | 2 647 301 | A2 | 10/2013 |
| GB | 2469850 | | 11/2010 |
| RU | 2017 102 574 | A | 8/2018 |
| RU | 2 670 534 | C1 | 10/2018 |
| WO | WO 1997/48293 | | 12/1997 |
| WO | WO 98/57556 | A1 | 12/1998 |
| WO | WO 2003/034847 | | 5/2003 |
| WO | WO 2004/043175 | | 5/2004 |
| WO | WO 2004/080216 | | 9/2004 |
| WO | WO 2005/099494 | | 10/2005 |
| WO | WO 2007/078273 | | 7/2007 |
| WO | WO 2007/131449 | | 11/2007 |

(56) References Cited

FOREIGN PATENT DOCUMENTS

| | | | |
|---|---|---|---|
| WO | WO 2009/105919 | | 9/2009 |
| WO | WO 2009/155734 | | 12/2009 |
| WO | WO 2010/003480 | | 1/2010 |
| WO | WO 2010/045670 | | 4/2010 |
| WO | WO 2010/073122 | | 7/2010 |
| WO | WO 2010/118644 | | 10/2010 |
| WO | WO 2010/140937 | | 12/2010 |
| WO | WO 2011/010334 | | 1/2011 |
| WO | WO 2012/072762 | | 6/2012 |
| WO | WO 2012/100523 | | 8/2012 |
| WO | WO 2012/164077 | A1 | 12/2012 |
| WO | WO 2013/089551 | | 6/2013 |
| WO | WO 2013/098380 | A1 | 7/2013 |
| WO | WO 2013/098405 | A2 | 7/2013 |
| WO | WO 2013/098410 | A2 | 7/2013 |
| WO | WO 2013/104914 | A1 | 7/2013 |
| WO | WO 2013/120849 | A1 | 8/2013 |
| WO | WO 2013/120854 | A1 | 8/2013 |
| WO | WO/2013/160112 | A2 | 10/2013 |
| WO | WO 2013/162028 | A1 | 10/2013 |
| WO | 2015101479 | A1 | 7/2015 |
| WO | 2015/179388 | A1 | 11/2015 |
| WO | WO 2015/179388 | | 11/2015 |
| WO | 2017068099 | A1 | 4/2017 |
| WO | 2017/109448 | A2 | 6/2017 |
| WO | WO 2017/098464 | | 6/2017 |
| WO | 2018122389 | A1 | 7/2018 |
| WO | 2019123296 | A1 | 6/2019 |
| WO | 2019123297 | A1 | 6/2019 |
| WO | 2019123298 | A1 | 6/2019 |
| WO | 2019123299 | A1 | 6/2019 |
| WO | 2019157874 | A1 | 8/2019 |
| WO | 2019175762 | A1 | 9/2019 |

* cited by examiner

SMOKING ARTICLE CARTRIDGE

FIELD OF THE DISCLOSURE

The present disclosure relates to products that incorporate tobacco and are intended for human consumption; and more particularly, to smoking articles that yield inhalable aerosols having considerably reduced quantities of incomplete combustion and pyrolysis products relative to tobacco products that produce smoke by burning tobacco.

BACKGROUND

Popular smoking articles, such as cigarettes, have a substantially cylindrical rod shaped structure and include a charge, roll, or column of smokable material, such as shredded tobacco (e.g., in cut filler form), surrounded by a paper wrapper, thereby forming a so called "smokable rod", "tobacco rod" or "cigarette rod." Normally, a cigarette has a cylindrical filter element aligned in an end to end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A traditional type of cigarette is employed by a user by lighting one end thereof and burning the tobacco rod. The user then receives mainstream smoke into his/her mouth by drawing on the opposite end (e.g., the filter end or mouth end) of the cigarette. Through the years, efforts have been made to improve upon the components, construction, and performance of smoking articles. See, for example, the background art discussed in U.S. Pat. No. 7,753,056 to Borschke et al.

As an alternative to burning tobacco, certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1 58 (2000). Additionally, a similar type of cigarette has been marketed in Japan by Japan Tobacco Inc. under the brand name "Steam Hot One."

Furthermore, various types of smoking products incorporating carbonaceous fuel elements for heat generation and aerosol formation recently have been set forth in the patent literature. See, for example, the types of smoking products proposed in U.S. Pat. No. 7,836,897 to Borschke et al.; U.S. Pat. No. 8,469,035 to Banerjee et al. and U.S. Pat. No. 8,464,726 to Sebastian et al.; U.S. Pat. No. 8,616,217 to Tsuruizumi et al; U.S. Pat. No. 8,915,255 to Poget et al.; U.S. Pat. No. 9,578,897 to Gladden et al.; U.S. Pat. No. 9,185,939 to Zuber et al.; U.S. Pat. No. 7,692,123 to Baba et al.; U.S. Pat. No. 8,616,217 to Tsuruizumi et al.; US Pat. Pub. Nos. 2012/0042885 to Stone et al.; 2013/0133675 to Shinozaki et al. and PCT WO Nos. 2013/098380 to Raether et al.; 2013/098405 to Zuber et al.; 2013/098410 to Zuber et al.; 2013/104914 to Woodcock; 2013/120849 to Roudier et al.; 2013/120854 to Mironov; which are incorporated by reference herein in their entirety. A historical perspective of technology related to various types of smoking products incorporating carbonaceous fuel elements for heat generation and aerosol formation may be found, for example, in the Background of US Pat. Pub. No. 2007/0215167 to Llewellyn Crooks et al., which is also incorporated herein by reference.

Many other smoking articles have been proposed through the years as improvements upon, or alternatives to, smoking products based upon combusting tobacco. Exemplary alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference.

The point of the improvements or alternatives to smoking articles typically has been to provide the sensations associated with cigarette, cigar, or pipe smoking, without delivering considerable quantities of incomplete combustion and pyrolysis products. To this end, there have also been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree.

It would be highly desirable to provide smoking articles that demonstrate the ability to provide to a user much of the enjoyment of conventional cigarette smoking, without delivering aerosol that incorporates considerable quantities of incomplete combustion and pyrolysis products.

BRIEF SUMMARY

In various implementations, the present disclosure provides a smoking article, comprising a mouth end portion and an aerosol generating cartridge in fluid communication with the mouth end portion. The smoking article also includes an enclosure configured to receive an aerosol precursor therein. The aerosol precursor is configured to generate an aerosol in response to heat. At least a portion of the enclosure is permeable such that the aerosol precursor is retained within the enclosure while the aerosol formed from the aerosol precursor is released from the enclosure through the permeable portion upon heating of the enclosure or the aerosol precursor therein.

In various implementations, the present disclosure provides an aerosol generating cartridge for use in a smoking article. The cartridge comprises an aerosol precursor and an enclosure configured to receive the aerosol precursor therein. The aerosol precursor is configured to generate an aerosol in response to heat. At least a portion of the enclosure is permeable such that the aerosol precursor is retained within the enclosure while the aerosol formed from the aerosol precursor is released from the enclosure through the permeable portion upon heating of the enclosure or the aerosol precursor therein.

In various implementations, the present disclosure provides a method of manufacturing a smoking article. The method includes inserting an aerosol precursor within an enclosure. The aerosol precursor is configured to generate an aerosol in response to heat. At least a portion of the enclosure is permeable such that the aerosol precursor is retained within the enclosure while the aerosol formed from the aerosol precursor is released from the enclosure through the permeable portion upon heating of the enclosure or the aerosol precursor therein. The method also includes at least partially circumscribing the aerosol generating cartridge with a first wrapping material to form a smoking article sub-assembly.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure or recited in any one or more of the claims, regardless of whether such features or elements are expressly combined or otherwise recited in a specific embodiment description or claim herein. This disclosure is intended to be read holistically such that any separable features or elements of the disclosure, in any of its aspects and embodiments, should be viewed as intended, namely to be combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying drawings which illustrate, by way of example, the principles of some described example implementations.

BRIEF DESCRIPTION OF THE DRAWING(S)

Figure 2:
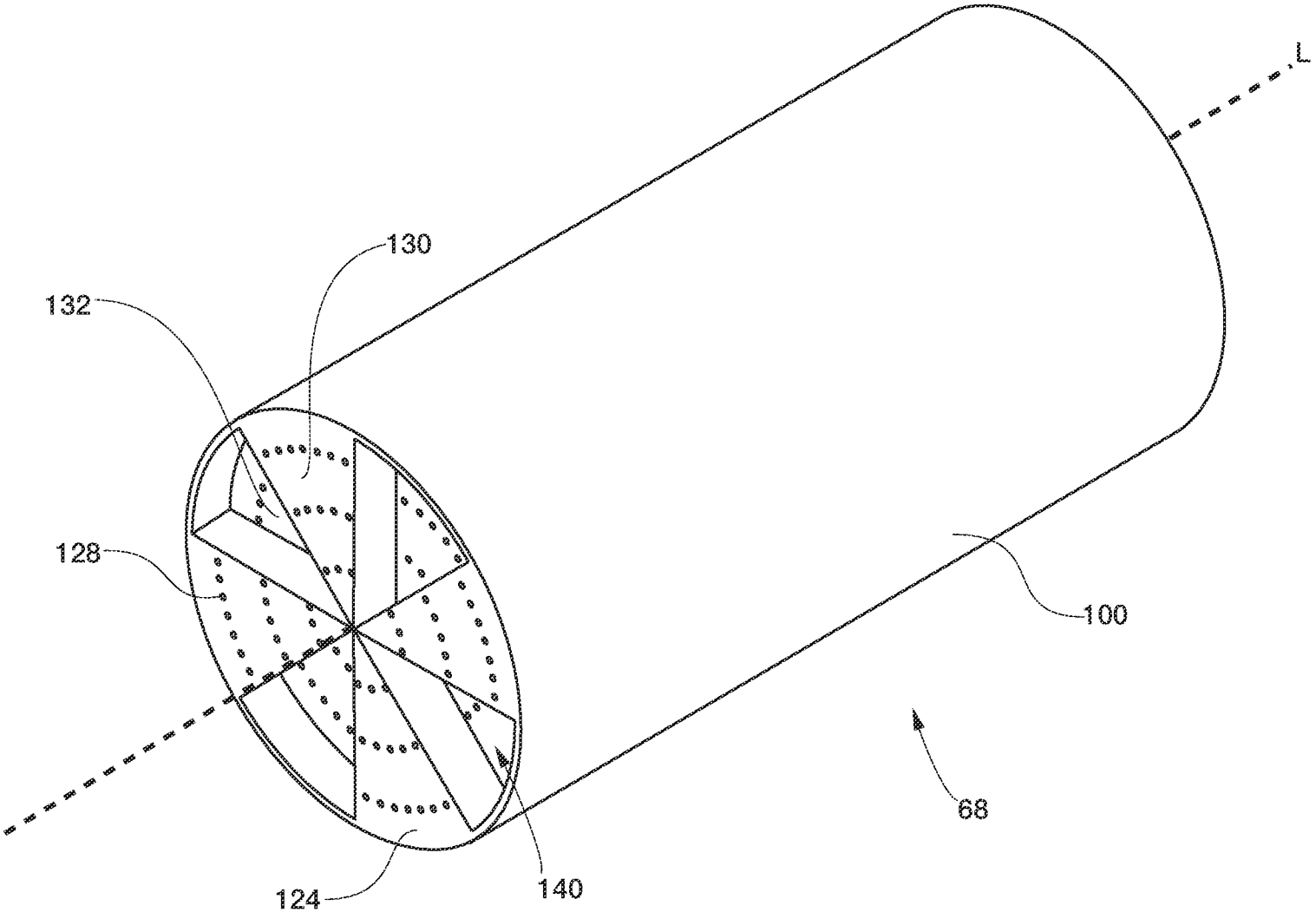

Having thus described the disclosure in the foregoing general terms, reference will now be made to the accompanying drawings, which are not necessarily drawn to scale, and wherein:

FIG. 1 schematically illustrates a longitudinal cross sectional view of a representative smoking article, according to one aspect of the disclosure;

FIG. 2 schematically illustrates a perspective view of the aerosol generating cartridge for use in the smoking article of FIG. 1.

Figure 3:
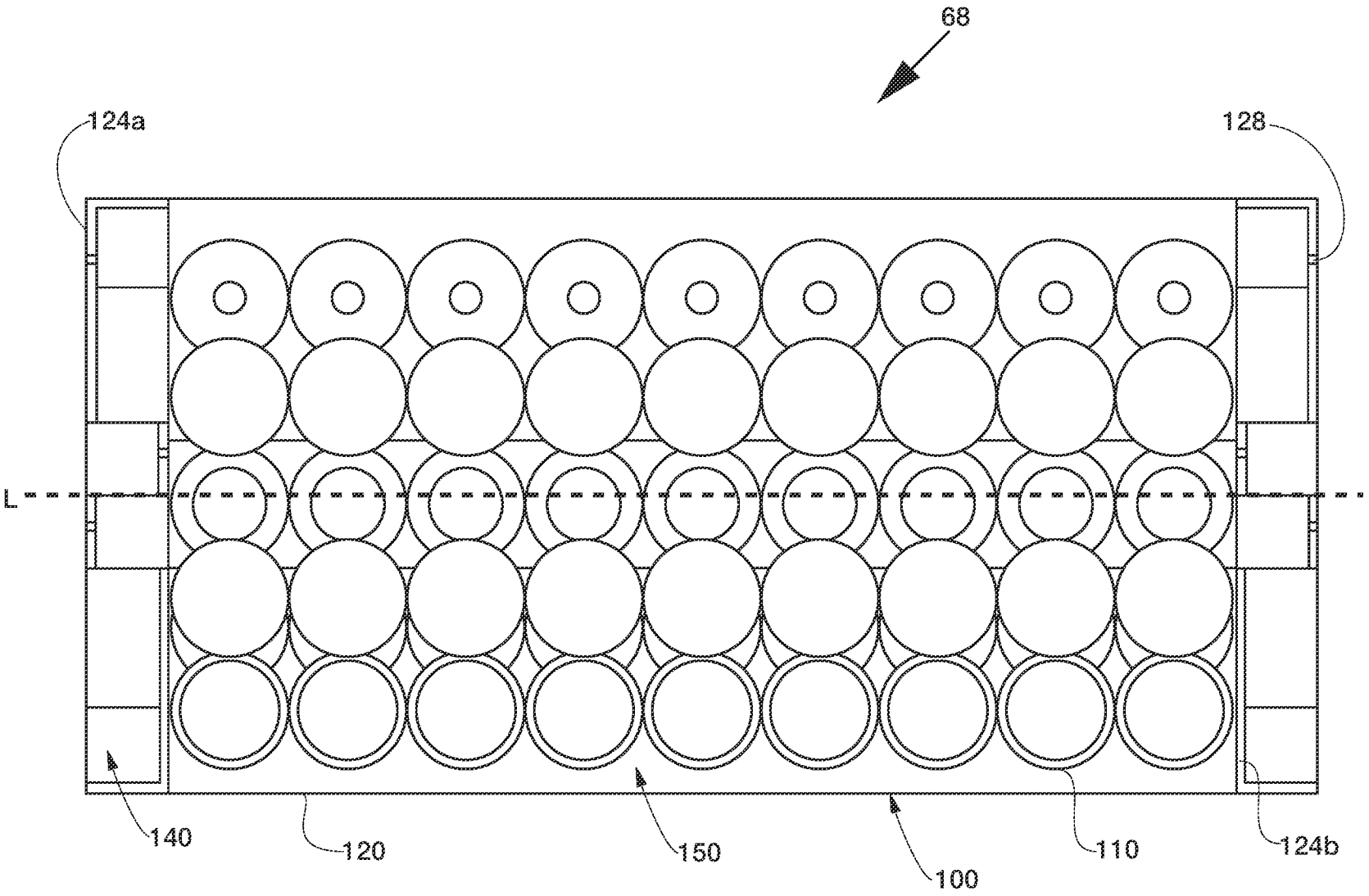

FIG. 3 schematically illustrates a detailed cross section view of the aerosol generating cartridge of FIG. 2.

Figure 4:
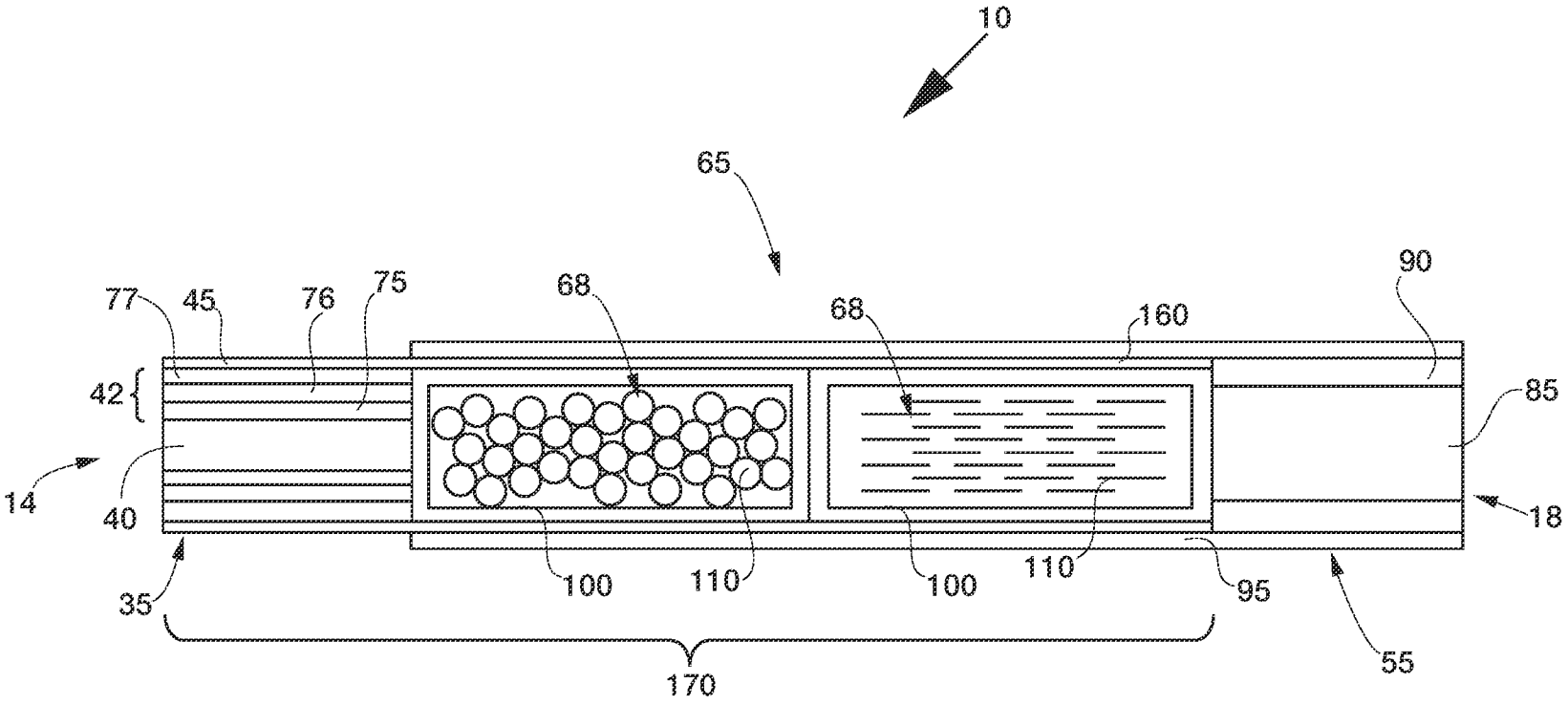

FIG. 4 schematically illustrates a longitudinal cross sectional view of a second representative smoking article, according to one aspect of the disclosure.

Figure 5:
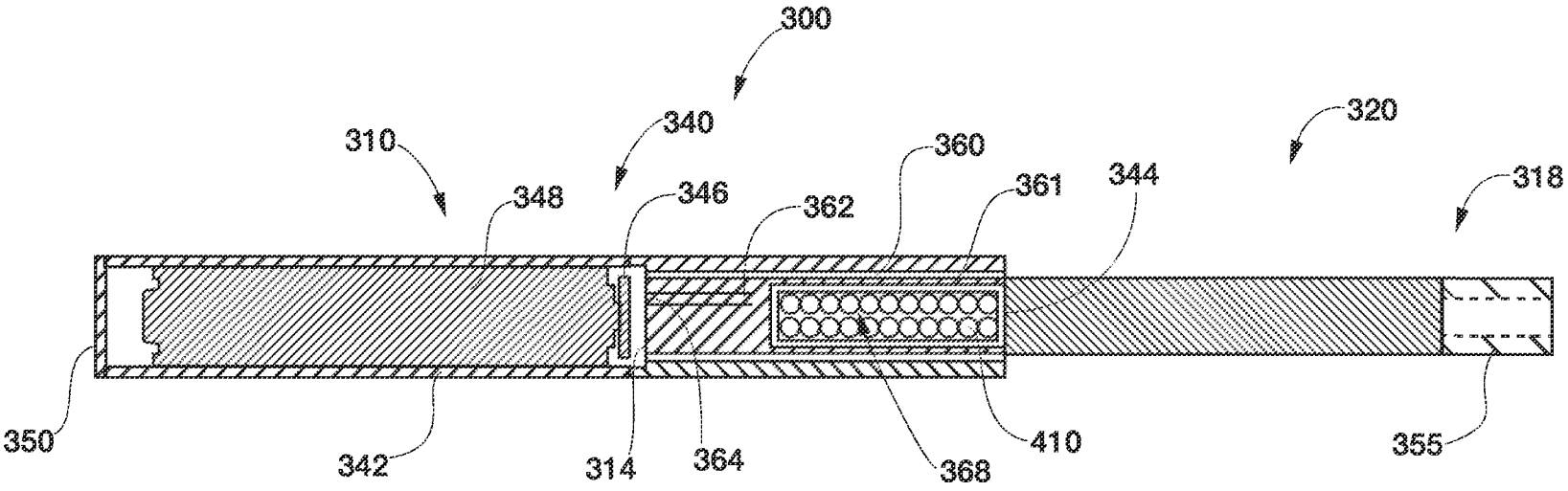

FIG. 5 schematically illustrates the aerosol generating cartridge, according to one aspect of the disclosure, incorporated into an aerosol source member to be electrically heated.

DETAILED DESCRIPTION

The present disclosure will now be described more fully hereinafter with reference to example implementations thereof. These example implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification and the appended claims, the singular forms "a," "an," "the" and the like include plural referents unless the context clearly dictates otherwise. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

FIG. 1 illustrates a representative smoking article 10 in the form of a cigarette, according to one aspect of the present disclosure. The smoking article 10 may have the overall size, shape, and general appearance of a filtered cigarette. In the illustrated embodiment, the smoking article 10 has a rod like shape, and includes a heated portion 14 and a mouth end portion 18. At the heated portion 14 (which in some aspects is, but is not necessarily, at an end of the smoking article 10) is positioned a longitudinally extending, generally cylindrical, heat generation segment 35. The heat generation segment 35 includes a heat source 40 circumscribed by insulation 42, which most preferably is coaxially encircled by an outer wrapping material 45. In the illustrated embodiment, the heat source 40 preferably is configured to be activated by direct ignition of the heated portion 14. That is, the heat source or fuel element is designed to be lit so as to burn or smolder, and hence produce heat. The smoking article 10 can also include a filter segment 55 located at the opposing end (i.e., mouth end portion 18) to the heated portion 14. Located in between the filter segment 55 and the heat generation segment 35 is an aerosol generating segment 65 that may include at least one aerosol generating cartridge 68 and may optionally include a tobacco rod 70. In various embodiments other components may exist between the aerosol generating cartridge 68 and the mouth end portion 18. For example, in some implementations, one or any combination of the following may be used, including: an air gap; phase change materials for cooling air; flavor releasing media; ion exchange fibers capable of selective chemical adsorption; aerogel particles as filter medium; and other suitable materials.

The heat generation segment 35 most preferably includes a combustible heat source 40 that has a generally cylindrical shape and incorporates a combustible carbonaceous material. Examples of combustible fuel elements are discussed in US 2017/0000188 to Nordskog, which is incorporated herein by reference in its entirety. Such combustible carbonaceous materials generally have high carbon content. Preferred carbonaceous materials are comprised predominantly of carbon, typically have carbon contents of greater than about 60 percent, generally greater than about 70 percent, often greater than about 80 percent, and frequently greater than about 90 percent, on a dry weight basis. Such combustible fuel elements can incorporate components other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). A representative heat source 40, for example, has a length of about 12 mm and an overall outside diameter of about 4.2 mm. A representative heat source 40 can be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis.

Another embodiment of the heat source 40 may include a foamed carbon monolith formed in a foam process. In another embodiment, the heat source 40 may be co-extruded with the insulation 42, thereby reducing manufacturing time and expense. Still other embodiments of heat sources, also referred to as fuel elements, may include those of the types described in U.S. Pat. No. 4,819,655 to Roberts et al. or U.S. Pat. App. Pub. No. 2009/0044818 to Takeuchi et al., each of which is incorporated herein by reference.

Carbonaceous fuel elements providing the heat source 40 may also include those types of components and configurations that have been incorporated within those cigarettes commercially marketed under the trade names "Premier," "Eclipse," "Revo," and "Steam Hot One." Additionally, representative types of heat generation segments, fuel element features, and representative components, designs and configurations thereof, as well as manners and methods for producing those heat generation segments and fuel elements therefor, are set forth in U.S. Pat. No. 4,714,082 to Banerjee et al.; U.S. Pat. No. 4,756,318 to Clearman et al.; U.S. Pat. No. 4,881,556 to Clearman et al.; U.S. Pat. No. 4,989,619 to Clearman et al.; U.S. Pat. No. 5,020,548 to Farrier et al.; U.S. Pat. No. 5,027,837 to Clearman et al.; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,461,879 to Barnes et al.; U.S. Pat. No. 5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; U.S. Pat. No. 5,727,571 to Meiring et al.; U.S. Pat. No. 7,836,897 to Borschke et al.; U.S. Pat. No. 8,617,263 to Banerjee et al. and U.S. Pat. No. 8,678,013 to Crooks; U.S. Pat. No. 9,220,301 to Banerjee; U.S. Pat. No. 9,345,268 to Stone et al.; U.S. Pat. No. 9,788,571 to Conner et al.; and U.S. Pat. App. Pub. Nos. 2005/0274390 to Banerjee et al.; and 2012/0042885 to Stone et al. See also, the types of fuel element configurations and components thereof that are described in U.S. Pat. No. 4,819,655 to Roberts et al. and U.S. Pat. App. Pub. No. 2009/0044818 to Takeuchi et al.

Certain fuel elements can contain high carbon content carbonaceous material that is obtained from cotton containing fiber (e.g., cotton linters) that have been carbonized or pyrolyzed. For descriptions of cotton linter materials that have been carbonized or pyrolyzed, and manners and methods that those materials have been incorporated into smoking articles, carbonized smoking materials, and fuel elements, see for example, U.S. Pat. No. 4,219,031 to Rainer et al.; U.S. Pat. No. 4,920,990 to Lawrence et al.; U.S. Pat. No. 5,007,440 to Robinson et al.; U.S. Pat. No. 5,060,673 to Lehman; U.S. Pat. No. 5,129,409 to White et al.; U.S. Pat. No. 5,211,684 to Shannon et al.; and U.S. Pat. No. 8,119,555 to Banerjee et al.

The insulation 42 of the heat generation segment 35 can be comprised of glass filaments or fibers. The insulation 42 can act as a jacket that assists in maintaining the heat source 40 firmly in place within the smoking article 10 (e.g., disposed between the heat source and the wrapping material 45. In an embodiment, the insulation 42 is provided in the form of a non-woven mat of glass filaments. The insulation 42 can be provided as a multi-layer component, for example, including an inner layer or mat 75 of non-woven glass filaments, an intermediate layer of reconstituted tobacco paper 76, and an outer layer of non-woven glass filaments 77. These layers may be concentrically oriented, or each overwrapping and/or circumscribing the heat source 40 in a continuous overlapping manner. Various other insulation embodiments may be molded, extruded, foamed, or otherwise formed. Particular embodiments of insulation structures may include those described in U.S. Pat. App. Pub. No. 2012/0042885 to Stone et al., which is incorporated by reference herein in its entirety.

The insulation may additionally be configured such that drawn air and aerosol can pass readily therethrough. Suitable insulation assemblies have been incorporated within those types of cigarettes commercially marketed under the trade names "Premier," "Eclipse" "Steam Hot One." Examples of insulation materials, components of insulation assemblies, configurations of representative insulation assemblies within heat generation segments, wrapping materials for insulation assemblies, and manners and methods for producing those components and assemblies, additionally are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,119,837 to Banerjee et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, III et al.; U.S. Pat. No. 5,546,965 to White; U.S. Pat. No. 5,727,571 to Meiring et al.; U.S. Pat. No. 5,902,431 to Wilkinson et al.; U.S. Pat. No. 5,944,025 to Cook et al.; U.S. Pat. No. 8,424,538 to Thomas et al.; U.S. Pat. No. 8,464,726 to Sebastian et al. and U.S. Pat. No. 8,678,013 Crooks et al.

In one embodiment, both ends of the heat generation segment 35 are open to expose at least the heat source 40 and insulation 42 at the heated portion 14. The heat source 40 and the surrounding insulation 42 can be configured so that the length of both materials is co-extensive (e.g., the ends of the insulation 42 are flush with the respective ends of the heat source 40, and particularly at the downstream end of the heat generation segment 35). Optionally, the insulation 42 can extend slightly beyond (e.g., from about 0.5 mm to about 2 mm beyond) either or both ends of the heat source 40. Moreover, heat and/or heated air produced when the heated portion 14 is ignited during use of the smoking article 10 can readily pass through the heat generation segment 35 during draw by the user on the mouth end portion 18, through the heat source 40 itself (e.g., through a longitudinal channel extending through the heat source 40) and/or longitudinally through the insulation 42.

In one embodiment, a wrapping material 45 circumscribes the insulation 42 over the longitudinally extending outermost surface of the heated portion 14 of the smoking article 10. The wrapping material 45 may be a paper wrapping material, such as, for example, the type of paper wrapping materials used as the circumscribing wrapping materials of the insulation regions of the heat source segments of the cigarettes marketed under the trade names "Premier" and "Eclipse" by R. J. Reynolds Tobacco Company. As such, the "wrapping material 45" may also be referred to as the "outer wrapping paper 45" to indicate such embodiment, but without limiting the wrapping material 45 to a paper wrapping material.

The heat generation segment 35 preferably is positioned with one end disposed at or very near the extreme of the heated portion 14, and is axially aligned in an end to end serial relationship with a downstream aerosol generating segment 65. The close proximity of the heat generation segment 35 to the heated portion 14 provides for direct ignition of the heat source 40 of the heat generation segment 35.

The cross sectional shape and dimensions of the heat generation segment 35, prior to burning during use, can vary. Preferably, the cross sectional area of the fuel element/heat source 40 makes up about 10 percent to about 35 percent, often about 15 percent to about 25 percent of the total cross sectional area of the heat generation segment 35; while the cross sectional area of the outer or circumscribing region (comprising the insulation 42 and relevant wrapping materials 45) makes up about 65 percent to about 90 percent, often about 75 percent to about 85 percent of the total cross sectional area of the heat generation segment 35. For example, for a cylindrical smoking article 10 having a circumference of about 24 mm to about 26 mm, a representative fuel element/heat source 40 has a generally circular cross sectional shape with an outer diameter of about 2.5 mm to about 5 mm, often about 3 mm to about 4.5 mm.

The mouth end portion 18 of the smoking article 10 may include a suitable mouthpiece such as, for example, the filter segment 55. The filter segment 55 may be positioned at one end of the aerosol generating segment 65, such that the filter segment 55 and the aerosol generating segment 65 are axially aligned in an end to end relationship, abutting one another and without a barrier therebetween. In one embodiment, the general cross sectional shapes and dimensions of those segments 55, 65 are essentially identical to one another when viewed transversely to the longitudinal axis of the smoking article 10. The filter segment 55 can include a filter material 85 that may be overwrapped along the longitudinally extending surface thereof with circumscribing plug wrap material 90. In one example, the filter material 85 includes plasticized cellulose acetate tow, or other suitable cigarette type filter material. Both ends of the filter segment 55 may be open to permit the passage of aerosol therethrough. In some instances, the filter segment 55 may be configured to include any combination of paper plug, void, and conventional cigarette filter material (e.g., cellulose acetate tow), as necessary or desired.

The filter segment 55 may also include flavor releasing features. In one example, one or more crushable flavor capsules may be included in the filter segment of the type described in U.S. Pat. No. 7,479,098 to Thomas et al. and U.S. Pat. No. 7,793,665 to Dube et al. and U.S. Pat. No. 8,186,359 to Ademe et al. Additional or alternative flavor releasing features may include flavored threads or delayed release capsules that release flavor in response to heated air drawn through the filter, with or without physical manipulation by the user.

The aerosol generating segment 65 may be attached to the filter segment 55 using tipping material 95. Examples of tipping materials are described, for example, in U.S. Pat. No. 7,789,089 to Dube et al., and in U.S. Pat. App. Publ. Nos. 2007/0215167 to Crooks et al., 2010/0108081 to Joyce et al., 2010/0108084 to Norman et al., and 2013/0167849 to Ademe et al.; and PCT Pat. App. Pub. No. 2013/160671 to Dittrich et al.

The smoking article 10 may include an air dilution provision, such as a series of perforations, each of which may extend through the tipping material 95 and the plug wrap material 90.

A representative smoking article 10 has a length of between about 80 mm and about 100 mm. For example, for a smoking article 10 having a length of about 85 mm, a representative heat generation segment 35 can have a length of between about 10 mm and about 15 mm, a representative aerosol generating segment 65 can have a length of between about 5 mm and about 55 mm, and a representative filter segment 55 can have a length of between about 20 mm and about 30 mm.

A longitudinally extending, generally cylindrical aerosol generating segment 65 is located downstream from the heat generation segment 35. The aerosol generating segment 65 includes at least one aerosol generating cartridge 68 and may optionally include a tobacco rod 70. In one embodiment, the at least one aerosol generating cartridge 68 is located between the heat generation segment 35 and the tobacco rod 70.

The aerosol generating cartridge 68 includes an enclosure 100 configured to receive an aerosol precursor therein. At least a portion of the enclosure 100 may be perforated or otherwise permeable so as to retain the aerosol precursor within the enclosure while permitting release therefrom through the perforated/permeable portion of an aerosol formed from the aerosol precursor upon heating of the enclosure 100 or the aerosol precursor therein. The aerosol precursor may be substantially entirely consumable into an aerosol as an aerosol forming agent. Alternatively, the aerosol precursor may be comprised of a solid or semi solid carrier 110 or substrate in combination with an aerosol forming agent or composition.

The use of one or more aerosol generating cartridges 68 may provide a significant improvement over the aerosol generating segment found in typical smoking articles. Particularly, the aerosol generating cartridges 68 may be created off-line using a cartridge manufacturing machine. The completed cartridge 68 may be then removed from the cartridge manufacturing machine and loaded into a smoking article assembly machine to be combined with other components to form the smoking article 10. The aerosol generating cartridge 68 is configured to provide a drop-in module that can be created in a large number of different varieties and plugged into the manufacturing process of the smoking article 10. Previously, the aerosol precursor would be incorporated into the aerosol generating segment during an on-line manufacturing process of a smoking article where the smoking article assembly machine accomplishes the step of adding the aerosol precursor. The use of the aerosol generating cartridge 68 avoids the step of charging a substrate during the on-line manufacturing process. The use of aerosol generating cartridges 68 can significantly increase the speed of production of the smoking article 10, especially in embodiments where the aerosol precursor includes small particles like beads or pellets, whose current containment within conventional smoking articles requires a slow filling process. The aerosol precursor is not limited to bead or pellet form factors and may include many other suitable substrates, such as cut filler, which are described in more detail below.

The enclosure 100 may be made from a variety of materials. Those materials include paper, tobacco, metals, and combinations thereof, such as a laminate material. An enclosure 100 made from paper may be made from various paper known in the art for manufacturing smoking articles. An enclosure 100 made from tobacco may be made from various extruded or reconstituted sheet tobacco compositions as are well known in the art. In one particular embodiment, the enclosure 100 may be made from metal. The metal may be a thin foil. In one embodiment, a thin foil layer is laminated with a paper layer. The enclosure 100, therefore, may be made from well-known wrap or wrapping materials, many of which are discussed herein. In another embodiment, a metal sheet may used to form the enclosure that is sufficiently thick to be self-supporting when retaining a carrier 110 therein. In an embodiment, the enclosure 100 is formed from a sheet of aluminum or stainless steel. In some embodiments, the metal sheet may have a thickness from about 12 μm to about 100 μm.

The enclosure 100 is shown in more detail in FIGS. 2 and 3. The enclosure 100 of the illustrated embodiment is a cylindrical shape as shown in the perspective view of FIG. 2 having a longitudinal axis L. The cylindrical shape may be beneficial if the enclosure 100 is used in a smoking article 10 having the shape of a typical cigarette. The shape of the enclosure 100 may alternatively take other shapes like elongated tube shapes with oval, rectangular, or square or other polygonal cross section. In further embodiments, the enclosure 100 may not be elongated and could be a cube or other suitable shape.

As better understood from the cross section of FIG. 3, the enclosure 100 of the illustrated embodiment may comprise a peripheral wall 120 having opposed first and second longitudinal ends. The longitudinal ends of the peripheral wall 120 may be capped by respective first and second end walls 124, respectively, extending across the first and second longitudinal ends of the peripheral wall. The first and second end walls 124 may be integral with the peripheral wall 120 or otherwise attached thereto. The end wall 124 may comprise a plurality of perforations 128 or may otherwise be permeable. In instances where the end wall 124 is perforated, the quantity, size, and arrangement of the perforations 128 may vary to adjust the flow of air through the enclosure 100 resulting from a draw on the smoking article 10 by the user. Such an end wall 124 may have any number of perforations 128 ranging from about four to about one-thousand. The perforations 128 are illustrated as arranged in concentric circles, but may also be arranged in virtually any pattern. The perforations may be arranged in a grid of rows and columns. The perforations may be arranged along radial lines extending from a center of the end walls 124 toward a periphery thereof. The perforations may be more densely arranged near the center of the end wall 124, may be most densely arranged near the periphery of the end wall, or some portion in between. Alternatively, the perforations may be evenly spaced across the end face (or end wall 124) of the enclosure 100. The perforations 128 may vary in size to control flow of air. In one example, the perforations 128 may have a diameter ranging from about 1 μm to about 1000 μm. The perforations are not limited to circular apertures, but may take alternative shapes, such as ovals, rectangles, linear slits, curved slits, etc.

In each embodiment, the size and shape of the perforations 128 should be selected such that the aerosol precursor, which may include a solid or semisolid carrier 110, remains retained within the enclosure 100 and is not likely to escape from the aerosol generating cartridge 68 prior to being sufficiently heated to form aerosols. In several embodiments, the size, shape, and arrangement of the perforations 128 are pre-determined and manufactured into the material of the end walls 124, with processes such as laser-based burning processes. In other embodiments, the porosity, diffusivity, or permeability of the material of the end walls 124 is selected to provide the desired retention of aerosol precursor and air flow without modifying the material to specifically create perforations. The perforations 128, or other openings to permit air flow, provided in the end wall 124*a* at a first end of the enclosure 100 are not necessarily the same quantity, size, shape or arrangement of perforations provided in the end wall 124*b* at the second end of the enclosure 100. In one embodiment, providing the end wall 124 at each end of the aerosol generating cartridge 68 with the same construction may increase manufacturing efficiency because the cartridge would not be directionally dependent when assembled into a smoking article 10. This arrangement may be described as providing the enclosure 100 with mirror symmetry about a plane that bisects the enclosure between the first and second longitudinal ends thereof. Additional manufacturing efficiency may be provided by designing the end walls 124 and the enclosure 100 as a whole to be rotationally symmetric about the longitudinal axis L. In another embodiment, the end wall 124 on each end of the enclosure may be unique, with one end wall 124*a* configured to be disposed toward the heat generation segment 35 and the other end wall 124*b* configured to be disposed toward the mouth end 18. The differences in the end walls 124*a*, 124*b* can vary the functionality with respect to air flow into the enclosure 100, aerosol flow out of the enclosure, as well as heat management.

In the illustrated embodiment of FIG. 2, the end walls 124 of the enclosure 100 may be formed with a first end wall portion 130 and a second end wall portion 132. The first and second end wall portions 130, 132 may be substantially parallel with one another and offset with respect to one another along the longitudinal direction L of the enclosure 100. The first end wall portion 130 may extend substantially perpendicular to a distal end of the peripheral wall 120. The second end wall portion 132 may be inset relative to the distal end of the peripheral wall. The result of insetting the second end wall portion 132 may be the creation of at least one pocket 140 that is recessed with respect to an end plane (e.g. the first end wall portion 130) of the aerosol generating cartridge 68. The pocket 140 may provide a convective air gap between the heat source 40 of the heat generation segment 35 and the aerosol precursor within the enclosure 100. The convective air gap created by the pocket 140 may, for example, help reduce scorching of the aerosol precursor.

The enclosure 100 may be produced by any number of manufacturing methods. For example, the peripheral wall 120 may be formed initially. Then one end wall 124 may be mounted to a longitudinal end of the peripheral wall 120 with an adhesive, friction fit, welding, or other securing arrangement. The peripheral wall 120 may be formed integrally with one of the end walls 124. The integral construction of the peripheral wall 120 and one of the end walls 124 may be created using additive manufacturing processes. After a chamber 150 (FIG. 3) of the enclosure 100 is at least partially filled with the aerosol precursor, the aerosol generating cartridge 68 may be completed by adding a second end wall 124*b* to the opposite end of the peripheral wall 120 to substantially fully enclose the aerosol precursor and provide for retaining the optional carrier 110 within the chamber 150.

In one embodiment, the enclosure 100 includes a preformed peripheral wall 120 (e.g. a tube). The tube may be made from a paper-foil laminate. A metallic wrapping material may be wrapped around the peripheral wall 120 with end regions extending beyond the ends of the preformed peripheral wall 120. The end regions of the wrapping material may be provided with the perforations 128 before or after being wrapped around the peripheral wall. Again, the wrapping material may be other materials as well, which may not require perforations to achieve the desired porosity or air permeability. To enclose each end of the peripheral wall, the end regions of the wrapping material may then be folded, for example in an envelope manner or a star manner. In one embodiment, one end of the peripheral wall 128 is closed by the folded end region of the wrapping material before the aerosol precursor is added. Then, the other end of the peripheral wall is closed by a folded end region of the wrapping material after the chamber within the peripheral wall is charged with the aerosol precursor. The folded end portions of the wrapping material, which form the end walls 124, may be unsealed or secured by adhesive into the folded configuration. Alternatively, after being folded, the wrapping material may be sufficient plastically deformed to remain folded and substantially closing an end of the peripheral wall such that adhesive or other fixing features are not necessary. To facilitate the folding step, a crease line, a pre-stressed score line, a line of perforations, or a line of cuts may be formed in the wrapping material before or after the wrapping material is provided around the peripheral wall. The arrangement of the crease lines, score lines, etc. can be selected based but the shape of the end of the peripheral wall that is being closed.

The aerosol precursor that is configured to be received within the chamber 150 of the enclosure 100 may include a carrier 110. The carrier 110 may be a portion of the aerosol precursor that is not dissolved, vaporized, or otherwise substantially released from the enclosure 100 upon suitable heating. The carrier 110 may be selected based upon elements such as its packing factor and cost, to control the strength of the aerosol generated, the cost of the product, and the useful life of the smoking article, often measured by a number of puffs. The carrier 110 may take a number of various solid or semi solid forms and include any number of alternative aerosol forming agents. In one example, the carrier 110 can include a reconstituted tobacco material that includes processing aids, flavoring agents, and/or glycerin. The carrier and/or the aerosol forming agent can incorporate tobacco. More particularly, if incorporating tobacco, the carrier can be comprised of a blend of flavorful and aromatic tobaccos, for example, in cut filler form. Those tobaccos, in turn, can be treated with an aerosol forming agent and/or at least one flavoring agent. The carrier 110 can also be comprised of a processed tobacco (e.g., a reconstituted tobacco manufactured using cast sheet or papermaking types of processes) in cut filler form. Certain cast sheet constructions may include about 270 mg to about 300 mg of tobacco per 10 mm of linear length of the cast sheet. In other instances, the carrier 110 can be comprised of a mixture of formed tobacco pellets. In particular aspects of the disclosure, the carrier 110 comprised of a form of tobacco, in turn, can be treated with, or processed to incorporate, an aerosol forming agent, which may include at least one flavoring agent, as well as a burn retardant (e.g., diammonium phosphate, other similar type of salt, and/or other suitable burn retardant materials). The inclusion of the burn retardant material with the carrier 110 may be configured to prevent ignition of the carrier.

As used herein, the term "tobacco pellets" is meant to include beads, pellets, or other discrete small units of tobacco that has been formed, shaped, compressed, extruded, or otherwise fashioned into a desired shape. For example, tobacco pellets can be formed using a so called marumarizing process. Tobacco pellets may have smooth, regular outer shapes (e.g., spheres, cylinders, ovoids, etc.) and/or they may have irregular outer shapes. In one example, the diameter of each tobacco pellet may range from less than about 1 mm to about 2 mm. The tobacco pellets may at least partially fill a substrate cavity of a smoking article, as described herein. That is, the carrier 110 may take the form of pellets or other loose objects that occupy a space within the enclosure 100 adjacent to and downstream of the heat generation segment 35. In one example, the volume of the enclosure 100 may range from about 500 $mm^3$ to about 700 $mm^3$ (e.g., an enclosure where the cavity diameter is about 7.5 to about 7.8 mm, and the cavity length is about 11 to about 15 mm, with the cavity having a generally cylindrical geometry). In one example, the mass of the tobacco pellets within the enclosure 100 may range from about 200 mg to about 500 mg. For example, the tobacco pellets can be employed so as to fill the enclosure 100 at a packing density of about 100 to about 400 $mg/cm^3$.

In one embodiment, the carrier 110 is formed in an extrusion process, and may include glycerin, milled tobacco, calcium carbonate, binder, flavorings, and water. More particularly, on a dry weight basis, the extrudate material may comprise about 37.86% milled tobacco, about 39.82% calcium carbonate, about 1.00% binder such as carboxymethyl cellulose (CMC) or cellulose gum, and about 21.32% glycerin and flavoring (with ~20% being glycerin).

In still other aspects, the material composition used for the extruded rods, namely, for example, glycerin, milled tobacco, calcium carbonate, binder, flavorings, and water, may instead be used to form a flat sheet having a thickness of between about 0.3 mm to about 1.7 mm. In some instances, the sheet can also be formed by an extrusion process (or molded or cast, as appropriate), wherein the sheet is then dried to form the carrier 110. The dried sheet can then be deconstructed, for example, by cutting the sheet into strips, or shredding the sheet. The cut/shredded portions of the formed sheet may then be stacked or gathered, and deposited in the enclosure 100, in a manner similar to cut filler tobacco (e.g., deposited instead of, but in a similar manner to, cut filler tobacco).

In some aspects, the carrier 110 may be comprised, for example, of cast sheets including a tobacco material. Such cast sheets can be formed in a process whereby a selected tobacco containing mixture is cast, dried, and cut into strips or shredded. In some instances, the cut strips or shredded portions of the cast sheet can be mixed with other cut fillers (e.g., a traditional cut filler tobacco, with or without an additional aerosol former) to provide desired taste and sensory perception of the user, as well as to facilitate the manufacturing process. In one example, the selected tobacco containing mixture may be characterized as a pectin release mixture comprising, for example, (on a dry weight basis) about 66.60% milled tobacco, about 3.75% diammonium phosphate, about 4.65% ammonium hydroxide, and about 25% glycerin and flavoring. To process the pectin release mixture, the milled tobacco, diammonium phosphate, ammonium hydroxide, and water may be heated to about 160° F. for about 1.5 hours, for example, to improve or enhance sensory qualities of the resulting mixture. The glycerin and flavorings may then be added to the remainder of the mixture upon cooling following the heating step. The resulting mixture may then be used to form the cast sheet.

In another example, the selected tobacco containing mixture may be characterized as a non-ammoniated mixture comprising, for example, (on a dry weight basis) about 65.62% milled tobacco, about 4.50% sodium alginate, about 1.13% sodium hydroxide or other pH adjuster, about 25% glycerin, and about 3.75% wood pulp. To process the non-ammoniated mixture, the milled tobacco, sodium alginate, and water may heated to about 160° F. for about 1.5 hours, for example, to improve or enhance sensory qualities of the resulting mixture. Hydrated wood pulp, the binder, glycerin and flavorings may then be added to the remainder of the mixture upon cooling following the heating step. The resulting mixture may then be used to form the cast sheet.

In another example, the selected tobacco containing mixture may be characterized as a tobacco containing reconstituted material comprising, for example, (on a dry weight basis) about 51.8% tobacco pulp, about 4.2% wood pulp, about 22.0% concentrated tobacco extract, and about 22.0% glycerin and flavorings. A sheet may be formed from the tobacco containing reconstituted material in a similar manner to conventional reconstituted sheet. For example, water soluble elements are first removed from the tobacco pulp lamina and the remaining tobacco pulp concentrated to about 25% solids content. The wood pulp may then be added to the tobacco pulp to form a base sheet that can vary in basis weight from between about 120 grams per square meter (gsm) to about 240 gsm. Glycerin is then mixed with concentrated tobacco derived nicotine (TDN) extract (e.g., in a 1:1 ratio) and added to the base sheet. The formed base sheet can then be dried, and cut into strips or shredded. Similar to cast sheets, the cut strips or shredded reconstituted sheets can be mixed with other cut fillers (e.g., a traditional cut filler tobacco, with or without an additional aerosol former) (e.g., a traditional cut filler tobacco, with or without an additional aerosol former).

In another example, the selected tobacco containing mixture may be characterized as a traditional cut filler tobacco material with elevated glycerin content. In such instances, the cut filler tobacco can be loaded or interacted with between about 5% and about 30% glycerin. The cut filler tobacco material with elevated glycerin content can subsequently be used as the carrier (e.g., the substrate material), or can be mixed with cast sheet material, such that the resulting mixture forms the carrier and the aerosol forming agent. Based on amount of glycerin necessary or desired, the glycerin can be applied to the cut filler tobacco, for example, as a casing for cutting (e.g., applied to individual strips of tobacco), as a top dressing, or as both. Such cut filler tobacco with elevated glycerin content can be, for example, mixed with various cast sheets, reconstituted sheets, and/or tobacco beads, as necessary or desired, to form the contents of the enclosure 100.

In yet another example, the selected tobacco containing mixture may be characterized as a non-tobacco material. For example, a cast sheet used to form a carrier, an extruded carrier, or a carrier in bead (marumerized) form, may include calcium carbonate, rice flour, a binder, diammonium phosphate, glycerin, flavorings, tobacco derived nicotine (TDN), and water. More particularly, such a non-tobacco cast sheet may be comprised of, for instance, about 41.25% calcium carbonate, about 13.75% rice flour, about 6% ammonium alginate, about 5.5% wood pulp, about 3.5% diammonium phosphate, and about 30% glycerin. In addition, tobacco derived nicotine (TDN), certain acids (e.g., levulinic acid and/or citric acid), and flavorings can be incorporated in the glycerin. An extruded carrier, or a carrier in bead (marumerized) form can be comprised of, for example, about 51.94% calcium carbonate, about 17.15% rice flour, about 1% TDN, about 1% carboxymethyl cellulose (CMC), about 0.66% levulinic acid, about 0.44% lactic acid, about 20% glycerin, and about 9.41% flavorings. In some instances, the cast sheet may be processed into cut strips, shredded, or processed into cut filler form. In other instances, if the carrier 110 includes beads, the beads may be positioned within the enclosure 100, to be adjacent to the heat generation segment 35, or to be closest to the heat generation segment.

In another example of a carrier formed of a non-tobacco material, tobacco derived nicotine (TDN), glycerin (e.g., an aerosol former), and flavorings can be added to an extruded ceramic substrate of relatively high porosity (e.g., a high porosity extruded ceramic rod member). In such instances, the ceramic rod member or members may be extruded so as to define one or more longitudinally extending channels (e.g., open channels or slots disposed about the outer surface and/or conduits extending through the central portion of the rod member).

The enclosure 100 is not limited to being filled by a single type of carrier or a single composition of aerosol forming agents. Any of the carriers and aerosol forming agent compositions, including flavorings and glycerin, may be disposed in combination within the enclosure 100. For example, the enclosure 100 may be filled with a combination of cast sheet and/or reconstituted sheet, each shredded or cut into strips, mixed with cut filler tobacco treated with glycerin. The cut filler tobacco can have various levels of glycerin ranging, for example, from about 5% to about 25%. In another example, cast sheet, shredded or cut into strips, may be mixed with tobacco containing beads.

Suitable carriers, i.e. substrates, and carriers incorporating aerosol forming agents (including cast sheet and paper type reconstituted tobacco materials), also are set forth in U.S. Pat. No. 4,793,365 to Sensabaugh et al.; U.S. Pat. No. 4,893,639 to White; U.S. Pat. No. 5,099,861 to Clearman et al.; U.S. Pat. No. 5,101,839 to Jakob et al.; U.S. Pat. No. 5,105,836 to Gentry et al.; U.S. Pat. No. 5,109,122 to Clearman et al.; U.S. Pat. No. 5,159,942 to Brinkley et al.; U.S. Pat. No. 5,203,355 to Clearman et al.; U.S. Pat. No. 5,271,419 to Arzonico et al.; U.S. Pat. No. 5,327,917 to Lekwauwa et al.; U.S. Pat. No. 5,396,911 to Casey, III et al.; U.S. Pat. No. 5,533,530 to Young et al.; U.S. Pat. No. 5,588,446 to Clearman; U.S. Pat. No. 5,598,868 to Jakob et al.; U.S. Pat. No. 5,715,844 to Young et al.; U.S. Pat. No. 6,378,528 to Beeson et al. and U.S. Pat. No. 8,678,013 Crooks, et al.; U.S. Pat. No. 9,149,072 to Conner et al.; and U.S. Pat. App. Pub. Nos. 2005/0066986 to Nestor et al.; and 2015/0157052 to Ademe et al. Additionally, carriers can have the types of forms or configurations set forth in U.S. Pat. No. 8,839,799 to Conner et al.; as a gathered web or sheet, using the types of techniques generally set forth in U.S. Pat. No. 4,807,809 to Pryor et al., or in the form of a web or sheet that is shredded into a plurality of longitudinally extending strands, using the types of techniques generally set forth in U.S. Pat. No. 5,025,814 to Raker.

The components of the aerosol forming agent portion of the aerosol precursor, optionally bound by a carrier 110, and configured to provide aerosols upon heating, can vary. The aerosol forming agent incorporates components that can be vaporized, aerosolized or entrained in air drawn through the smoking article during use. Most preferably, those components, separately or in combination, provide sensory and organoleptic effects, such as aroma, flavor, mouth feel, visible aerosol sensations, and the like. Examples of components of the aerosol forming agents that are drawn into the mouth of the user during draw include water (e.g., as water vapor), visible aerosol forming materials (e.g., glycerin), various volatile flavors (e.g., vanillin or menthol), volatile components of tobacco (e.g., nicotine), and the like.

One suitable aerosol forming agent produces a visible aerosol upon the application of sufficient heat thereto, or otherwise through the action of aerosol forming conditions brought about by components of the smoking article. A desirable aerosol forming material or agent produces a visible aerosol that can be considered to be "smoke like." A suitable aerosol forming agent is chemically simple, relative to the chemical nature of the smoke produced by burning tobacco. One visible aerosol forming agent is a polyol, and another aerosol forming agents include glycerin, propylene glycol, and mixtures thereof. If desired, aerosol forming agents can be combined with other liquid materials, such as water. For example, aerosol forming agent formulations can incorporate mixtures of glycerin and water, or mixtures of propylene glycol and water. See, for example, the various aerosol forming materials referenced in U.S. Pat. No. 4,793,365 to Sensabaugh, Jr. et al.; U.S. Pat. No. 5,101,839 to Jakob et al.; U.S. Pat. No. 6,779,531 to Biggs et al.; and U.S. Pat. No. 8,678,013 Crooks, et al.

The manner by which the aerosol forming agent is contacted with the carrier 110 (e.g., the tobacco material) can vary. The aerosol forming agent can be applied to a formed tobacco material, or can be incorporated into processed tobacco materials during manufacture of those materials. The aerosol forming agent can be dissolved or dispersed in an aqueous liquid, or other suitable solvent or liquid carrier, and sprayed onto that carrier. See, for example, U.S. Patent Application Pub. No. 2005/0066986 to Nestor et al. The amount of aerosol forming agent employed relative to the dry weight of carrier can vary.

Cast sheet types of materials may incorporate relatively high levels of aerosol forming agent. Reconstituted tobaccos manufactured using paper making types of processes may incorporate moderate levels of aerosol forming agent. Tobacco strip and cut filler tobacco can incorporate lower amounts of aerosol forming agent. Various paper and non-paper substrates including gathered, laminated, laminated metal/metallic, strips, beads such as alumina beads, open cell foam, foamed monolith, air permeable matrices, and other materials can be used within the scope of the disclosure. See, for example, U.S. Pat. Nos. 5,183,062; 5,203,355; and 5,588,446; each to Clearman.

The laminated paper or other wrapping material may be constructed in accordance with the disclosure of U.S. Pat. No. 6,849,085 to Marton, or in accordance with other appropriate methods and/or materials.

Further, various combinations and varieties of flavoring agents (including various materials that alter the sensory and/or organoleptic character or nature of mainstream aerosol of a smoking article) can be incorporated within suitable smoking articles. The substrate material and various tobacco components of the smoking article can be treated with tobacco additives of the type that are traditionally used for the manufacture of cigarettes, such as casing and/or top dressing components. See, for example, the types of components set forth in U.S. Pat. No. 8,678,013 Crooks, et al.

FIG. 4 shows a second embodiment where the aerosol generating segment 65 may comprise a plurality of aerosol generating cartridges 68. The contents of each enclosure 100 of each aerosol generating cartridge 68 may be the same or different from one another. The differences could be manifest in differences in the carrier and/or differences in one or more components of the aerosol forming agent of the aerosol precursor. The differences in the aerosol forming agent may include differences in the flavorings or in the additives themselves or in the concentration of those additives.

The aerosol precursor in each enclosure 100 may be selected to make use of the thermal profile of the smoking article 10. The thermal profile of the smoking article 10 is understood to reflect that the portion of the smoking article at the heat generation segment 35 is the hottest and portion (s) at a distance from the heat source 40 are relatively cooler. Therefore, where two aerosol generating cartridges 68 are present, the aerosol forming agent within the cartridge toward the mouth end 18 of the smoking article may be selected to vaporize at a lower temperature than the aerosol forming agent in the cartridge directly adjacent to the heat generation segment 35.

In other embodiments, the enclosure 100 of an aerosol generating cartridge 68 may itself be sub-divided into sub-compartments. The carrier and/or a portion of the aerosol forming agent in each sub-compartment may vary. The sub-compartments may be arranged serially along an axis intending to extend between the heated portion 14 and the mouth end portion 18 of the smoking article 10. In other embodiments, the sub-compartments may be arranged in parallel along the length of the enclosure 100.

Dividing walls between the sub-compartments, whether extending along or transverse to the longitudinal axis of the enclosure 100, may be formed of similar materials as the peripheral wall 120 and the end walls 124 (e.g. paper, tobacco, metal foil, or combinations and laminates thereof). The material forming the dividing walls may have porosity, diffusivity, and/or permeability to facilitate the desired flow of air through the aerosol generating cartridge 68 upon a draw from a user.

The foregoing components of the aerosol generating segment 65, including at least one aerosol generating cartridge 68 and an optional tobacco rod 70, can be disposed within, and circumscribed by, a wrapping material 160. The wrapping material 160 can be configured to facilitate the transfer of heat from the heated portion 14 of the smoking article 10 (e.g., from the heat generation segment 35) to components of the aerosol generating segment 65. That is, the aerosol generating segment 65 and the heat generation segment 35 can be configured in a heat exchange relationship with one another, wherein such a heat exchange relationship can be facilitated by the wrapping material 160 circumscribing both the heat generation segment 35 and the aerosol generating segment 65 to form a sub-assembly. The heat exchange relationship is such that sufficient heat from the heat source 40 is supplied to the aerosol generating segment 65 to volatilize/aerosolize an aerosol forming agent for aerosol formation and generation. In some instances, the wrapping material 160 may be a discrete component in relation to the outer wrapping material 45, or may be engaged with the outer wrapping material 45 in various manners. In other instances, the wrapping material 160 may comprise an insulating material for insulating the aerosol generating cartridge 68 from the outer wrapping material 45. For example, the wrapping material 160 may comprise a glass fiber mat having a thickness of between about 50 μm and about 500 μm.

In one embodiment of the present disclosure, the heat exchange relationship is achieved by serially positioning the heat generation segment 35 and the aerosol generating segments 65 in proximity to one another. In some instances, those segments may be serially arranged in end to end contact with each other. A heat exchange relationship also can be achieved by extending a heat conductive material from the vicinity of the heat source 40 into and/or around the region occupied by the aerosol generating segment 65. For example, in one embodiment, a representative wrapping material 160 can include heat conductive elements or properties for conducting heat from the heat generation segment 35 to the aerosol generating segment 65 (and/or maintaining the heat in interaction with the aerosol generating segment 65 along a length thereof), in order to provide for the aerosolization of the aerosol forming agents contained within at least the aerosol generating cartridge. In other embodiments, the representative wrapping material 160 and/or the outer wrapping material 45 may include heat conductive properties for dissipating heat not directed from the heat generation segment 35 to the aerosol generating segment 65, and/or for uniformly or more consistently distributing heat between the heat generation segment 35 and the aerosol generating segment 65, while still providing for the aerosolization of the aerosol forming agents contained in at least the enclosure 100 of the aerosol generating cartridge 68. Such a wrapping material 160 can be provided by a laminated paper/foil sheet, for example, comprised of an outer layer of a paper type material sheet and an inner layer of a heat conductive metallic foil sheet. The metal foil sheet forming the inner layer can, for instance, extend from a region downstream from the heat source 40, and along at least a portion of the length of the aerosol generating segment 65. The metal foil/inner layer laminate can be associated with the outer layer in the form of one or more discrete, longitudinally extending strips affixed to the outer layer, or in the form of a continuous sheet that cooperates with the outer layer to circumscribe the noted region overlapping the heat generation and aerosol generating segments 35, 65.

In embodiments where the wrapping material 160 is selected for heat conduction, the wrapping material, in the form of a laminated paper/foil sheet, may have a typical length (e.g., along the aerosol generating segment 65) of between about 8 mm and about 50 mm for a representative smoking article of the type described herein. The laminated paper/foil sheet can be perforated, etched, embossed or primed, for example, to facilitate ease of manufacturing. In some instances, the thickness of the foil used in the laminate can be varied or increased/decreased as necessary or desired, for example, between about 0.0001 inches and 0.005 inches, in order to alter performance of the laminated paper/foil sheet and/or to reduce visual scorching of the paper sheet portion of the laminate and/or the outer wrapping paper 45.

The laminated paper/foil sheet of the wrapping material 160 can be formed in different manners. For example, a heat conductive ink (in some instances, a heat conductive metallic ink) may be used to print on the paper portion such that the printed ink forms a foil layer (sheet or strip) on the paper portion (and/or may be at least partially absorbed into/integrated with the paper portion). Such a heat conductive ink may include, for example, carbon, graphite, graphene, silver, or any other suitable heat or thermally conductive material or combinations thereof, to conduct heat along the paper portion, with the conducted heat, in turn, heating the aerosol generating cartridge to generate an aerosol therefrom. In one embodiment, heat conductive inks can be printed according to a continuous pattern or a discontinuous pattern on foil sheets or conventional cigarette papers, with basis weights of the cigarette paper ranging from about 20 gsm to about 100 gsm.

In other instances, a heat or thermally conductive material such as, for example, a metallic foil (e.g., silver), a conductive carbon material (e.g., graphene), or any other suitable heat conductive material or combinations thereof, may be deposited on or otherwise attached in various configurations (e.g., discrete strip, full sheet, complete coating, etc.) to a conventional cigarette paper, e.g., using a "island placement" or selective deposition/engagement technology, for example, to facilitate ease of manufacturing and to enhance functionality. In any instance, the implementation of the laminated paper/foil sheet as the wrapping material 160 may, in some cases, dissipate or redirect heat produced by the heat generation segment 35 to reduce scorching of the outer wrapping paper 45 and/or other components of the smoking article 10. As such, the elimination of scorching may improve the taste or sensory perception of the generated aerosol to the user.

In other embodiments, the wrapping material 160 may comprise a tri-laminate sheet comprising a cigarette paper layer, a foil layer, and a tobacco paper layer. The tobacco paper layer composition may vary and can be comprised of and include different ratios, for example, of burley tobacco, flue cured tobacco, oriental tobacco, or any other suitable type of tobacco or combinations thereof. The tobacco inclusion in the tobacco paper layer may be up to about 85% tobacco, and the tobacco paper layer may have a basis weight ranging from about 20 gsm to about 100 gsm. In some instances, the tri-laminate form of the wrapping material 160 may be comprised of tobacco paper/foil/tobacco paper, as necessary or desired. In other instances, a bi-laminate of tobacco paper/foil may be implemented, wherein the tobacco sheet can be laminated to an aluminum or other heat conductive foil having a thickness ranging from about 0.0005 inches to about 0.002 inches, wherein such a bi-laminate sheet may exhibit a basis weight of between about 60 gsm and about 100 gsm.

According to yet further embodiments, the wrapping material 160 may be configured as any of a paper foil sheet laminate, a paper foil paper sheet laminate, a paper foil tobacco sheet laminate, a non-woven graphite sheet, a non-woven graphite and graphene composite sheet, a graphene sheet, a graphene foil sheet laminate, a graphene foil paper sheet laminate, a paper graphene sheet laminate, a graphene ink imprinted on a paper sheet, a graphene ink imprinted on a foil sheet, carbon nanotubes engaged with a paper sheet or a foil sheet, fullerenes engaged with a paper sheet or a foil sheet, and graphene engaged with a paper sheet or a foil sheet. In such instances, for example where graphene comprises one of the outer layers of the laminate, it may be desirable for the graphene layer of the laminate to provide the initial layer of the laminate closest to the aerosol generating cartridge 68. In other instances, for example, in the case of a graphene foil sheet laminate, it may be desirable for the foil sheet layer of the laminate to provide the initial layer of the laminate closest to the aerosol generating cartridge 68, while the graphene layer functions as a heat shield between the aerosol generating cartridge 68 and the outer wrapping material 45, or the order could be reversed, wherein the graphene layer of the laminate is the initial layer of the laminate closest to the aerosol generating cartridge 68, while the foil sheet layer functions as a heat shield between the aerosol generating cartridge 68 and the outer wrapping material 45. In instances where the wrapping material 160 comprises a heat conducting layer and a paper sheet or foil sheet, an insulating layer or thermal layer may be disposed therebetween.

In embodiments comprising imprinting, for example, of a graphene ink, the ink may be applied using a variety of printing processes such as, for instance, gravure printing, flexographic printing, offset printing, screen printed, ink jet printing, or other appropriate printing method, in order to provide varying thicknesses, patterns, surface coverage, and composition gradients.

The outer wrapping paper 45 is generally configured to wrap around the heat generation segment 35 and to extend longitudinally (downstream) so as to also wrap about the aerosol generating segment 65 and along at least a portion of the length thereof. In so being engaged to wrap about the noted components of the smoking article 10, the outer wrapping paper 45 also extends over the interface between the heat generation segment 35 and the aerosol generating segment 65. In some embodiments, the outer wrapping paper 45 may be treated with, interacted with, or otherwise exposed to, for example, calcium carbonate ($CaCO_3$), aluminum hydroxide, magnesium hydroxide, and/or combinations thereof as fillers in the paper matrix of the outer wrapping paper 45 at least as anti-scorching agents.

One skilled in the art will also appreciate that the wrapping material 160 and/or the outer wrapping material 45, when wrapped about the appropriate components of the smoking article, may have the opposing ends thereof (e.g., the angularly overlapping ends forming a longitudinally extending seam along the smoking article) sealed together, for example, by an adhesive material. Accordingly, in some embodiments of the disclosure, the adhesive material may also include a filler such as, for example, calcium carbonate ($CaCO_3$), aluminum hydroxide, magnesium hydroxide, and/or combinations thereof, in order to reduce, minimize or eliminate scorching or charring of the adhesive material and/or the outer wrapping material 45 along the longitudinally extending seam of the outer wrapping material 45 wrapped about the components of the smoking article.

Additional manners and methods for assembling representative types of smoking articles are set forth in U.S. Pat. No. 5,469,871 to Barnes et al. and U.S. Pat. No. 8,678,013 Crooks, et al.; U.S. Pat. No. 9,149,072 to Conner et al.; and U.S. Pat. App. Pub. Nos. 2012/0042885 to Stone et al.; 2014/0261470 to Amiss et al.; and 2015/0157052 to Ademe et al.

In some embodiments, both ends of the aerosol generating segment 65 are open to expose the at least one aerosol generating cartridge thereof. Together, the heat generating segment 35 and the aerosol generating segment 65 form an aerosol generation sub-assembly 170. The aerosol generating segment 65 is positioned adjacent to the downstream end of the heat generation segment 35 such that those segments are axially aligned in an end to end relationship. Those segments can abut one another, or be positioned in a slightly spaced apart relationship, which may include an optional buffer region created by the pocket 140 in the end wall 124 of the enclosure 100. The outer cross sectional shapes and dimensions of those segments, when viewed transversely to the longitudinal axis of the smoking article 10, can be essentially identical to one another. The physical arrangement of those components preferably is such that heat is transferred (e.g., by mechanisms that includes conductive and convective heat transfer) from the heat source 40 to the aerosol precursor, throughout the time that the heat source is actuated (e.g., ignited) during use of the smoking article 10.

As mentioned above, the one or more pockets 140 may reduce potential scorching or other thermal degradation of portions of the aerosol generating segment 65. Other heat buffers may also be provided as the result of regions that are partially or substantially completely filled with a non-combustible material such as, for example, metal, organic, inorganic, ceramic, or polymeric materials, or any combination thereof. The buffers may be from about 1 mm to about 10 mm or more in thickness (length), but often will be about 2 mm to about 5 mm in thickness (length). If desired, the buffers can incorporate catalytic materials, such as materials incorporating cerium or copper ions or oxides and/or salts of cerium and copper ions. See, for example, U.S. Pat. No. 8,469,035 to Banerjee et al.; U.S. Pat. No. 8,617,263 to Banerjee et al.; and U.S. Pat. No. 9,220,301 to Banerjee et al.

Smoking articles 10 described with reference to FIGS. 1-4 may be used in much the same manner as those cigarettes that have been commercially marketed under the trade names "Premier," "Revo," and "Eclipse" by R. J. Reynolds Tobacco Company, and "Steam Hot One" by Japan Tobacco Inc. That is, the fuel element or heat source 40 is lit using a match or cigarette lighter. The burning fuel element/heat source resulting from such ignition produces heat which is transferred to the aerosol generating cartridge 68 within the aerosol generating segment 65. The aerosol precursor, including the aerosol forming agents, and tobacco flavors and components, are heated and volatilize/aerosolize, while within the enclosure 100, to form aerosol. That aerosol is entrained in drawn air, and drawn through the filter segment 55 into the mouth of the user.

FIG. 5 schematically illustrates another embodiment of the present disclosure. Where FIGS. 1-4 illustrate an embodiment of a smoking article 10 configured to generate heat by igniting the heat source 40, the smoking article 300 of FIG. 5 is configured to use electrical energy to generate heat to promote formation of an inhalable substance. Example devices are described in U.S. application Ser. No. 15/799,365 to Sebastian et al, filed Oct. 31, 2017, which is incorporated herein by reference in its entirety. The smoking article 300 also can be characterized as being vapor producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke like.

In some embodiments, the smoking article 300 may include a control body 310 and an aerosol source member 320. The control body 310 may be reusable, whereas the aerosol source member 320 may be configured for a limited number of uses and/or configured to be disposable. In various implementations the aerosol source member 320 includes an aerosol precursor contained within an enclosure, forming an aerosol generating cartridge 368. In order to heat the aerosol source member 320, particularly the aerosol precursor therein, at least a portion of a heating device may be positioned in a receptacle provide in the control body 310. The heating device may generate heat using electrical current supplied by one or more power sources, which may be rechargeable or replaceable. The heating device may be a resistive heater or an inductive heater. Where an inductive heater is utilized, both a resonant transmitter and a resonant receiver may be substantially permanently housed within the control body 310. In other embodiments, the resonant receiver may be provided as a portion of the aerosol source member 320. The resonant receiver may be a dedicated component of the aerosol source member 320, or the function of the resonant receiver may be accomplished by the aerosol generating cartridge 368 of the aerosol source member.

FIG. 5 illustrates device smoking article 300 according to an example implementation of the present disclosure. The smoking article 300 may include a control body 310 and an aerosol source member 320. In various implementations, the aerosol source member and the control body can be permanently or detachably aligned in an operable relationship. In this regard, FIG. 5 illustrates the smoking article 300 in a coupled configuration. Various mechanisms may connect the aerosol source member 320 to the control body 310, such as a threaded engagement, a press fit engagement, an interference fit, a sliding fit, a magnetic engagement, or the like. In various implementations, the control body 310 of the smoking article 300 may be substantially rod-like, substantially tubular shaped, substantially cylindrically shaped or the control body may take another hand held shape, such as a small box shape.

In specific implementations, one or both of the control body 310 and the aerosol source member 320 may be referred to as being disposable or as being reusable. For example, the control body 310 may have a replaceable battery or a rechargeable battery, solid state battery, thin film solid state battery, rechargeable supercapacitor or the like, and thus may be combined with any type of recharging technology, including connection to a wall charger, connection to a car charger (e.g., cigarette lighter receptacle), and connection to a computer, such as through a universal serial bus (USB) cable or connector (e.g., USB 2.0, 3.0, 3.1, USB Type C), connection to a photovoltaic cell (sometimes referred to as a solar cell) or solar panel of solar cells, or wireless radio frequency (RF) based charger. Further, in some implementations, the aerosol source member 320 may comprise a single use device.

In various implementations of the present disclosure, the aerosol source member may comprise a heated portion 314, which is configured to be inserted into the control body 310, and a mouth end portion 318, upon which a user draws to create the aerosol. The heated portion 314 may designate any portion of the aerosol source member that is inserted into the control body 310. The heated portion is not limited to a distal tip or terminal end of the aerosol source member. Some or all of the heated portion 314 may receive heat from the control body 310. Alternatively, some or all of the heated portion 314 may be configured to generate heat in the presence of eddy currents. In various implementations, the heated portion 314 may include an aerosol precursor contained within an aerosol generating cartridge 368. In other embodiments, the aerosol generating cartridge 368 may be positioned outside of the control body 310, in whole or in part, when the aerosol source member is engaged with the control body. The aerosol generating cartridge 368 may include an enclosure and an aerosol precursor consistent with any embodiment of the aerosol generating cartridge 68 for use in the smoking articles 10 described above and illustrated in FIGS. 1-4.

In various implementations, the mouth end portion 318 of the aerosol source member 320 may include a filter segment 355, which may be made of a cellulose acetate or polypropylene material. In various implementations, the filter segment 355 may increase the structural integrity of the mouth end portion of the aerosol source member 320, and/or provide filtering capacity, if desired, and/or provide resistance to draw. For example, an article according to an embodiment of the present disclosure can exhibit a pressure drop of about 50 mm to about 250 mm water pressure drop at 17.5 cc/second air flow. In further implementations, pressure drop can be about 60 mm to about 180 mm or about 70 mm to about 150 mm. Pressure drop value may be measured using a Filtrona Filter Test Station (CTS Series) available from Filtrona Instruments and Automation Ltd or a Quality Test Module (QTM) available from the Cerulean Division of Molins, PLC. The thickness of the filter segment along the length of the mouth end portion 318 of the aerosol source member 320 can vary—e.g., about 2 mm to about 20 mm, about 5 mm to about 20 mm, or about 10 mm to about 15 mm. In some implementations, the filter segment 355 may be held in position by an overwrap material. The overwrap material may be consistent with the overwrap materials 45, 95, and 160 discussed above in order to join the at least one aerosol generating cartridge 368 to a filter segment 355.

Exemplary types of overwrapping materials, wrapping material components, and treated wrapping materials that may be used in overwrap in the present disclosure are described in U.S. Pat. No. 5,105,838 to White et al.; U.S. Pat. No. 5,271,419 to Arzonico et al.; U.S. Pat. No. 5,220,930 to Gentry; U.S. Pat. No. 6,817,365 to Hancock et al.; U.S. Pat. No. 6,908,874 to Woodhead et al.; U.S. Pat. No. 6,929,013 to Ashcraft et al.; U.S. Pat. No. 7,195,019 to Hancock et al.; U.S. Pat. No. 7,216,652 to Fournier et al.; U.S. Pat. No. 7,276,120 to Holmes; and U.S. Pat. No. 7,275,548 to Hancock et al., which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer Maudit International. The porosity of the wrapping material can vary, and frequently is between about 5 CORESTA units and about 30,000 CORESTA units, often is between about 10 CORESTA units and about 90 CORESTA units, and frequently is between about 8 CORESTA units and about 80 CORESTA units.

To maximize aerosol and flavor delivery which otherwise may be diluted by radial (e.g., outside) air infiltration through the overwrap, one or more layers of non-porous cigarette paper may be used to envelop the aerosol source member (with or without the overwrap present). Examples of suitable non-porous cigarette papers are commercially available from Kimberly Clark Corp. as KC 63 5, P878 5, P878 16 2 and 780 63 5. Preferably, the overwrap is a material that is substantially impermeable to the vapor formed during use of the smoking article 300. If desired, the overwrap can comprise a resilient paperboard material, foil lined paperboard, metal, polymeric materials, or the like, and this material can be circumscribed by a cigarette paper wrap. The overwrap may comprise a tipping paper that circumscribes the component and optionally may be used to attach a filter material to the aerosol source member, as otherwise described herein.

In one example the control body 310 facilitates the generation of heat with an inductive heater 340. The inductive heater 340 includes a resonant transformer comprising a resonant transmitter and a resonant receiver. In particular, the control body 310 may comprise a housing 342 that includes an opening 344 defined in an engaging end thereof, a flow sensor (e.g., a puff sensor or pressure switch), a control component 346 (e.g., a microprocessor, individually or as part of a microcontroller, a printed circuit board (PCB) that includes a microprocessor and/or microcontroller, etc.), a power source 348 (e.g., a battery, which may be rechargeable, and/or a rechargeable supercapacitor), and an end cap that includes an indicator 350 (e.g., a light emitting diode (LED)).

Examples of power sources are described in U.S. Pat. No. 9,484,155 to Peckerar et al., and U.S. Pat. App. Pub. No. 2017/0112191 to Sur et al., filed Oct. 21, 2015, the disclosures of which are incorporated herein by reference in their respective entireties. With respect to the flow sensor, representative current regulating components and other current controlling components including various microcontrollers, sensors, and switches for aerosol delivery devices are described in U.S. Pat. No. 4,735,217 to Gerth et al., U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., U.S. Pat. No. 7,040,314 to Nguyen et al., and U.S. Pat. No. 8,205,622 to Pan, all of which are incorporated herein by reference in their entireties. Reference also is made to the control schemes described in U.S. Pat. No. 9,423,152 to Ampolini et al., which is incorporated herein by reference in its entirety.

In one implementation, the indicator 350 may comprise one or more light emitting diodes, quantum dot-based light emitting diodes or the like. The indicator 350 can be in communication with the control component 346 and be illuminated, for example, when a user draws on the aerosol source member 320, when coupled to the control body 310, as detected by the flow sensor.

Still further components can be utilized in the smoking article of the present embodiment of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth end of a device to detect user lip activity associated with taking a draw and then trigger heating of a heating device; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and PCT Pat. App. Pub. No. WO 2010/003480 by Flick discloses a fluid flow sensing system indicative of a puff in an aerosol generating system; all of the foregoing disclosures being incorporated herein by reference in their entireties.

Further examples of components related to electronic smoking articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al.; U.S. Pat. No. 8,851,083 to Oglesby et al.; U.S. Pat. Nos. 8,915,254 and 8,925,555 to Monsees et al.; U.S. Pat. No. 9,220,302 to DePiano et al.; U.S. Pat. App. Pub. Nos. 2006/0196518 and 2009/0188490 to Hon; U.S. Pat. App. Pub. No. 2010/0024834 to Oglesby et al.; U.S. Pat. App. Pub. No. 2010/0307518 to Wang; PCT Pat. App. Pub. No. WO 2010/091593 to Hon; and PCT Pat. App. Pub. No. WO 2013/089551 to Foo, each of which is incorporated herein by reference in its entirety. Further, U.S. Pat. App. Pub. No. 2017/0099877 to Worm et al. discloses capsules that may be included in smoking articles and fob shape configurations for smoking articles, and is incorporated herein by reference in its entirety. A variety of the materials disclosed by the foregoing documents may be incorporated into the present devices in various implementations, and all of the foregoing disclosures are incorporated herein by reference in their entireties.

The control body 310 of the implementation depicted in FIG. 5 includes a resonant transmitter and a resonant receiver, which together form the resonant transformer. The resonant transformer of various implementations of the present disclosure may take a variety of forms, including implementations where one or both of the resonant transmitter and resonant receiver are located substantially permanently within the control body 310 of the smoking article 300.

In the particular implementation depicted in FIG. 5, the resonant transmitter comprises a laminate that includes a foil material 360 that surrounds a support cylinder 361, and the resonant receiver of the depicted embodiment comprises a plurality of receiver prongs 362 that extend from a receiver base member 364. In some implementations, the foil material may include an electrical trace printed thereon, such as, for example, one or more electrical traces that may, in some implementations, form a helical pattern when the foil material is positioned around the resonant receiver. In various implementations, the resonant receiver and the resonant transmitter may be constructed of one or more conductive materials, and in further implementations the resonant receiver may be constructed of a ferromagnetic material including, but not limited to, cobalt, iron, nickel, and combinations thereof. In the illustrated implementation, the foil material 360 is constructed of a conductive material and the receiver prongs 362 are constructed of a ferromagnetic material. In various implementations, the receiver base member 364 may be constructed of a non-conductive and/or insulating material.

As illustrated, the resonant transmitter 360 may extend proximate an engagement end of the housing 342, and may be configured to substantially surround the portion of the heated portion 314 of the aerosol source member 320 that includes the aerosol generating cartridge 368. In such a manner, the resonant transmitter 360 of the illustrated implementation may define a tubular configuration. As illustrated in FIG. 5, the resonant transmitter 360 may surround a support cylinder 361. The support cylinder 361 may also define a tubular configuration, and may be configured to support the foil material 360 such that the foil material 360 does not move into contact with, and thereby short circuit with, the resonant receiver prongs 362. In such a manner, the support cylinder 361 may comprise a nonconductive material, which may be substantially transparent to an oscillating magnetic field produced by the foil material 360. In various implementations, the foil material may be embedded in, or otherwise coupled to, the support cylinder. In the illustrated implementation, the foil material 360 is engaged with an outer surface of the support cylinder 361; however, in other implementations, the foil material may be positioned at an inner surface of the support cylinder or be fully embedded in the support cylinder.

In the illustrated implementation, the support cylinder 361 may also serve to facilitate proper positioning of the aerosol source member 320 when the aerosol source member is inserted into the housing 342. In particular, the support cylinder 361 may extend from the opening 344 of the housing 342 to the receiver base member 364. In the illustrated implementation, an inner diameter of the support cylinder 361 may be slightly larger than or approximately equal to an outer diameter of a corresponding aerosol source member 320 (e.g., to create a sliding fit) such that the support cylinder 361 guides the aerosol source member 320 into the proper position (e.g., lateral position) with respect to the control body 310. In the illustrated implementation, the control body 310 is configured such that when the aerosol source member 320 is inserted into the control body, the receiver prongs 362 are located in the approximate radial center of the heating end 314 of the aerosol source member 320.

In various implementations, the transmitter support member 361 may engage an internal surface of the housing 342 to provide for alignment of the support member with respect to the housing. Thereby, as a result of the fixed coupling between the support member 361 and the resonant transmitter 360, a longitudinal axis of the resonant transmitter may extend substantially parallel to a longitudinal axis of the housing 342. In various implementations, the resonant transmitter 360 may be positioned out of contact with the housing 342, so as to avoid transmitting current from the transmitter coupling device to the outer body. In some implementations, an insulator may be positioned between the resonant transmitter 360 and the housing 342, so as to prevent contact therebetween. As may be understood, the insulator and the support member may comprise any nonconductive material such as an insulating polymer (e.g., plastic or cellulose), glass, rubber, ceramic, and porcelain. Alternatively, the resonant transmitter may contact the housing in implementations in which the housing is formed from a nonconductive material such as a plastic, glass, rubber, ceramic, or porcelain.

In some embodiments, the aerosol generating cartridge 368 may be configured at least partially from conductive or ferromagnetic materials to function as the resonant receiver. For example, as discussed above, the enclosure of the aerosol generating cartridge 368 may be an aluminum or other metal material that could be suitable for functioning as the resonant receiver. Additionally or alternatively, the carrier or other component of the aerosol precursor within the enclosure may be made from a material that is suitable for use as the resonant receiver, e.g. is constructed of a material that will generate heat in the presence of an alternating magnetic field generated by a resonant transmitter. In other embodiments, a wrapping material 45, 95 used to assemble the aerosol source member 320 may include at least a portion thereof, such as a foil layer, that is suitable to function as the resonant receiver. In further embodiments, a dedicated resonant receiver component is fixed to the aerosol generating cartridge 368 when forming the aerosol source member 320. Unlike the illustrated embodiment of FIG. 5, where the resonant receiver comprises prongs 362 formed as part of the control body 310, each of the above described variations implements the resonant receiver as a portion of the aerosol source member 320 for removal from the opening 344 when the aerosol source member 320 is depleted of aerosol forming agent.

As noted above, the aerosol source members 320 of the present disclosure are configured to operate in conjunction with a control body 310 to produce an aerosol. In particular, when an aerosol source member 320 is coupled to a control body 310 (e.g., when an aerosol source member is inserted into a control body), the resonant transmitter may at least partially surround, may substantially surround, or may fully surround the resonant receiver (e.g., by extending around the circumference thereof). Further, the resonant transmitter may extend along at least a portion of the longitudinal length of the resonant receiver, may extend along a majority of the longitudinal length of the resonant receiver, or may extend along substantially all or more than the longitudinal length of the resonant receiver. In addition, in various implementations, when an aerosol source member is inserted into a control body, the resonant receiver may extend at least a portion of the longitudinal length of the aerosol generating segment 365, may extend along a majority of the longitudinal length of the aerosol generating segment, or may extend along substantially all or more than the longitudinal length of the aerosol generating segment.

In use, when a user draws on the mouth end portion of the aerosol source member 320, the resonant transmitter may thereby produce an oscillating magnetic field. As a result of the resonant receiver being positioned inside of the area defined by the resonant transmitter, the resonant receiver may be exposed to the oscillating magnetic field produced by the resonant transmitter. In particular, the resonant transmitter and the resonant receiver together form a resonant transformer. In some examples, the resonant transformer and associated circuitry including the inverter may be configured to operate according to a suitable wireless power transfer standard such as the Qi interface standard developed by the Wireless Power Consortium (WPC), the Power Matters Alliance (PMA) interface standard developed by the PMA, the Rezence interface standard developed by the Alliance for Wireless Power (A4WP), and the like.

According to example embodiments, a change in current in the resonant transmitter, as directed thereto from the power source by the control component, may produce an alternating electromagnetic field that penetrates the resonant receiver, thereby generating electrical eddy currents within the resonant receiver. The alternating electromagnetic field may be produced by directing alternating current to the resonant transmitter. As noted above, in some embodiments, the control component may include an inverter or inverter circuit configured to transform direct current provided by the power source to alternating current that is provided to the resonant transmitter.

The eddy currents flowing in the material defining the resonant receiver may heat the resonant receiver through the Joule effect, wherein the amount of heat produced is proportional to the square of the electrical current times the electrical resistance of the material of the resonant receiver. In implementations of the resonant receiver comprising ferromagnetic materials, heat may also be generated by magnetic hysteresis losses. Several factors contribute to the temperature rise of the resonant receiver including, but not limited to, proximity to the resonant transmitter, distribution of the magnetic field, electrical resistivity of the material of the resonant receiver, saturation flux density, skin effects or depth, hysteresis losses, magnetic susceptibility, magnetic permeability, and dipole moment of the material.

In this regard, both the resonant receiver and the resonant transmitter may comprise an electrically conductive material. By way of example, the resonant transmitter and/or the resonant receiver may comprise various conductive materials including metals such as copper and aluminum, alloys of conductive materials (e.g., diamagnetic, paramagnetic, or ferromagnetic materials) or other materials such as a ceramic or glass with one or more conductive materials embedded therein. In another implementation, the resonant receiver may comprise conductive particles. In some implementations, the resonant receiver may be coated with or otherwise include a thermally conductive passivation layer (e.g., a thin layer of glass).

Accordingly, in various implementations the resonant receiver may be heated by the resonant transmitter. The heat produced by the resonant receiver may heat the aerosol precursor while the aerosol precursor is within the aerosol generating cartridge 368 such that an aerosol is produced within the cartridge. By positioning the resonant receiver near the aerosol precursor, and at a substantially uniform distance therefrom, the aerosol precursor may be substantially uniformly heated.

The aerosol may mix with air entering through ventilation holes/inlets, which may be defined in the housing of the control body. For example, in some embodiments, ventilation holes may be defined around a periphery of the housing upstream from the heated end of the aerosol source member. Accordingly, an air and aerosol mixture may be directed to the user. For example, the air and aerosol mixture may be directed to the user through a filter on the mouth end of the aerosol source member. However, as may be understood, the flow pattern through the smoking article may vary from the particular configuration described above in any of various manners without departing from the scope of the present disclosure.

In some implementations, the aerosol source member may further comprise an authentication component, which may be configured to allow for authentication of the aerosol source member. Thereby, for example, the control component may direct current to the resonant transmitter only when the aerosol source member is verified as authentic. In some implementations, the authentication component may comprise a radio frequency identification (RFID) chip configured to wirelessly transmit a code or other information to the control body. Thereby, the smoking article may be used without requiring engagement of electrical connectors between the aerosol source member and the control body. Further, various examples of control components and functions performed thereby are described in U.S. Pat. No. 9,854,841 to Ampolini et al., which is incorporated herein by reference in its entirety.

As indicated above, in some implementations, the control component of the control body may include an inverter or an inverter circuit configured to transform direct current provided by the power source to alternating current that is provided to the resonant transmitter. The inverter may also include an inverter controller embodied as an integrated circuit and configured to output a signal configured to drive the resonant transmitter to generate an oscillating magnetic field and induce an alternating voltage in the resonant receiver when exposed to the oscillating magnetic field. This alternating voltage causes the resonant receiver to generate heat and thereby creates an aerosol from the aerosol forming agent.

In some examples, the control body may further protect against the temperature of the resonant receiver reaching or exceeding a threshold temperature. In some of these examples, the control component may include a microprocessor configured to receive a measurement of an alternating current induced in the resonant receiver. The microprocessor may then control operation of at least one functional element of the smoking article in response to the measurement, such as to reduce the temperature of the resonant receiver in instances in which the measurement indicates a temperature at or above a threshold temperature. One manner of reducing temperature may be to reduce, modulate, and/or stop the current supplied to resonant transmitter. Some examples are described in U.S. Pat. App. Pub. No. 2017/0196263 to Sur, which is incorporated herein by reference in its entirety.

Further examples of various induction based control components and associated circuits are described in U.S. Pat. App. Pub. Nos. 2017/0202266 and 2018/0132531 to Sur et al., each of which is incorporated herein by reference in its entirety.

In light of possible interrelationships between aspects of the present disclosure in providing the noted benefits and advantages associated therewith, the present disclosure thus particularly and expressly includes, without limitation, embodiments representing various combinations of the disclosed aspects. Thus, the present disclosure includes any combination of two, three, four, or more features or elements set forth in this disclosure, regardless of whether such features or elements are expressly combined or otherwise recited in the description of a specific embodiment herein. This disclosure is intended to be read holistically such that any separable features or elements of the disclosure, in any of its aspects and embodiments, should be viewed as intended, namely to be combinable, unless the context of the disclosure clearly dictates otherwise.

Many modifications and other aspects of the disclosures set forth herein will come to mind to one skilled in the art to which these disclosures pertain having the benefit of the teachings presented in the foregoing descriptions and the associated drawings. For example, those of skill in the art will appreciate that embodiments not expressly illustrated herein may be practiced within the scope of the present disclosure, including that features described herein for different embodiments may be combined with each other and/or with currently known or future developed technologies while remaining within the scope of the claims presented here.

Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation. Aspects of the present disclosure are more fully illustrated by the examples herein, which are set forth to illustrate certain aspects of the present disclosure and are not to be construed as limiting the scope thereof. Unless otherwise noted, all parts and percentages are by weight.

That which is claimed:

1. A smoking article, comprising:

a mouth end portion; and an aerosol generating cartridge in fluid communication with the mouth end portion, and comprising:

an enclosure configured to receive an aerosol precursor therein, the aerosol precursor being configured to generate an aerosol in response to heat, at least a portion of the enclosure being permeable such that the aerosol precursor is retained within the enclosure while the aerosol formed from the aerosol precursor is released from the enclosure through the permeable portion upon heating of the enclosure or the aerosol precursor therein, the enclosure further defining first and second end wall portions, wherein the second end wall portion is inset relative to the first end wall portion so as to define two or more pockets that are recessed with respect to an end plane of the cartridge, each pocket defining a void space that creates a convective air gap, wherein each of the two or more recessed pockets is positioned adjacent a first end wall portion.

2. The article of claim 1, further comprising an ignitable heat generation element disposed opposite the aerosol generating cartridge from the mouth end portion of the smoking article, the heat generation element being comprised of a carbonized material or a pyrolyzed material.

3. The article of claim 2, further comprising a tobacco rod disposed between the aerosol generating cartridge and the mouth end portion or between the aerosol generating cartridge and the heat generation element.

4. The article of claim 1, wherein the mouth end portion comprises a filter element in fluid communication with the aerosol generating cartridge.

5. The article of claim 1, wherein the aerosol precursor comprises tobacco beads, tobacco pellets, extruded tobacco, cast sheet tobacco in cut filler form, a sheet of a reconstituted tobacco material in cut filler form, aerosol forming beads, alumina beads, a ceramic material, a cast sheet of a non-tobacco material in cut filler form, a glass fiber mat, a foil sheet, gathered paper, or a gel, or various combinations thereof.

6. The article of claim 1, wherein the enclosure is comprised of tobacco, paper, or metal, or various combinations thereof.

7. The article of claim 6, wherein the enclosure is comprised of a paper-foil laminate.

8. The article of claim 1, wherein the enclosure includes an elongate peripheral wall defining an elongate hollow cylinder having opposed first and second longitudinal ends, and first and second end walls respectively extending laterally across the first and second longitudinal ends of the peripheral wall.

9. The article of claim 8, wherein one of the first end wall and the second end wall is perforated to release the aerosol from the enclosure.

10. The article of claim 9, wherein the first end wall and the second end wall are perforated.

11. The article of claim 8, wherein one of the first end wall and the second end wall is offset from the respective first and second longitudinal end of the peripheral wall.

12. The article of claim 11, wherein the first end wall includes the first end wall portion and the second end wall portion, wherein the first end wall portion and the second end wall portion are not co-planar.

13. The article of claim 12, wherein the first portion is offset from the second portion along a longitudinal axis of the peripheral wall.

14. The article of claim 8, wherein the enclosure is symmetric about a longitudinal axis of the peripheral wall.

15. The article of claim 8, wherein the enclosure is symmetric about a plane bisecting the peripheral wall between the first and second ends thereof.

16. The article of claim 8, wherein one of the first wall and the second end wall is formed separately from the peripheral wall and engaged with the peripheral wall by welding, an adhesive, or a friction fit.

17. The article of claim 8, wherein one of the first wall and the second wall includes a folded wrapping material extending laterally across one of the first and second longitudinal ends of the peripheral wall, and along the peripheral wall as a layer thereof.

18. The article of claim 1, further comprising a control body, the control body comprising at least a portion of a heating device associated with a receptacle defined by the control body, wherein the receptacle is configured to receive an end portion of the aerosol generating cartridge, the end portion being opposite the mouth end portion.

19. The article of claim 18, wherein the heating device is an electric resistance heater configured to generate heat for heating the enclosure or the aerosol precursor therein.

20. The article of claim 18, wherein the heating device is an inductive heater comprising a resonant transmitter.

21. The article of claim 20, wherein the aerosol generating cartridge comprises a resonant receiver configured to cooperate with the resonant transmitter to generate heat for heating the enclosure or the aerosol precursor therein.

22. The article of claim 21, wherein the resonant receiver is attached to the aerosol generating cartridge.

23. The article of claim 21, wherein the enclosure includes the resonant receiver.

24. The article of claim 1, wherein the aerosol generating cartridge comprises a plurality of aerosol generating cartridges, with the aerosol precursor in a first one of the plurality of aerosol generating cartridges having at least one different component than the aerosol precursor in a second one of the plurality of aerosol generating cartridges.

25. The article of claim 24, wherein the first one of the plurality of aerosol generating cartridges and the second one of the plurality of aerosol generating cartridges are serially disposed with respect to each other.

26. The article of claim 1, comprising a wrapping material circumscribing at least a portion of the aerosol generating cartridge, the wrapping material comprising a paper foil sheet laminate, a paper foil paper sheet laminate, a paper foil tobacco sheet laminate, a non-woven graphite sheet, a graphene sheet, a graphene foil sheet laminate, a graphene foil paper sheet laminate, a paper graphene sheet laminate, a graphene ink imprinted on a paper sheet, a graphene ink imprinted on a foil sheet, carbon nanotubes engaged with a paper sheet or a foil sheet, fullerenes engaged with a paper sheet or a foil sheet, or graphene engaged with a paper sheet or a foil sheet, or various combinations thereof.

27. A smoking article, comprising:

a mouth end portion;

an aerosol generating cartridge in fluid communication with the mouth end portion, wherein the aerosol generating cartridge comprises an enclosure configured to receive an aerosol precursor therein, the aerosol precursor being configured to generate an aerosol in response to heat; and a tobacco rod disposed between the aerosol generating cartridge and the mouth end portion, wherein the aerosol generating cartridge comprises an enclosure that includes an elongate peripheral wall defining an elongate hollow cylinder having opposed first and second longitudinal ends, wherein the first longitudinal end defines a first end wall extending laterally thereacross, and wherein the second longitudinal end abuts the tobacco rod, wherein the enclosure further defines first and second end wall portions, wherein the second end wall portion is inset relative to the first end wall portion so as to define two or more pockets that are recessed with respect to an end plane of the cartridge, each pocket defining a void space that creates a convective air gap, wherein each of the two or more recessed pockets is positioned adjacent a first end wall portion.

28. The smoking article of claim 27, wherein the mouth end portion comprises a filter element in fluid communication with the aerosol generating cartridge.

29. The article of claim 27, further comprising a wrapping material circumscribing at least a portion of the enclosure and at least a portion of the tobacco rod, the wrapping material comprising at least one of a paper foil sheet laminate, a paper foil paper sheet laminate, a paper foil tobacco sheet laminate, a non-woven graphite sheet, a graphene sheet, a graphene foil sheet laminate, a graphene foil paper sheet laminate, a paper graphene sheet laminate, a graphene ink imprinted on a paper sheet, a graphene ink imprinted on a foil sheet, carbon nanotubes engaged with a paper sheet or a foil sheet, fullerenes engaged with a paper sheet or a foil sheet, or graphene engaged with a paper sheet or a foil sheet, or various combinations thereof.

30. The article of claim 27, wherein the enclosure comprises at least one of tobacco, paper, or metal, or various combinations thereof.

31. The article of claim 27, wherein the enclosure is symmetric about a longitudinal axis of the peripheral wall.

* * * * *